US010067449B2

(12) United States Patent
Matsuda et al.

(10) Patent No.: US 10,067,449 B2
(45) Date of Patent: Sep. 4, 2018

(54) FIXING DEVICE AND IMAGE FORMING APPARATUS

(71) Applicants: Ryohei Matsuda, Kanagawa (JP); Yutaka Ikebuchi, Kanagawa (JP); Yasunori Ishigaya, Kanagawa (JP); Kazuya Saito, Kangawa (JP); Keitaro Shoji, Kanagawa (JP)

(72) Inventors: Ryohei Matsuda, Kanagawa (JP); Yutaka Ikebuchi, Kanagawa (JP); Yasunori Ishigaya, Kanagawa (JP); Kazuya Saito, Kangawa (JP); Keitaro Shoji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/194,090

(22) Filed: Jun. 27, 2016

(65) Prior Publication Data

US 2017/0010571 A1 Jan. 12, 2017

(30) Foreign Application Priority Data

Jul. 9, 2015 (JP) ..... 2015-137769
Apr. 21, 2016 (JP) ..... 2016-085141

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
CPC ..... G03G 15/2053; G03G 15/2082; G03G 15/2042; G03G 2215/2035
USPC ..... 399/328, 329, 334
See application file for complete search history.

(56) References Cited

U.S. PATENT DOCUMENTS

2010/0239292 A1 9/2010 Fujita et al.
2011/0044706 A1 2/2011 Iwaya et al.
2011/0058862 A1 3/2011 Yamaguchi et al.
2011/0058864 A1 3/2011 Fujimoto et al.
2011/0182634 A1 7/2011 Ishigaya et al.
(Continued)

FOREIGN PATENT DOCUMENTS

AP 2013-164430 8/2013
AP 2015-064560 4/2015
(Continued)

*Primary Examiner* — Hoang Ngo
(74) *Attorney, Agent, or Firm* — Oblon, McClelland, Maier & Neustadt, L.L.P.

(57) ABSTRACT

A fixing device includes a primary heater and a secondary heater that heat a fixing rotator. The primary heater includes a primary major heat generation portion and a primary minor heat generation portion. The primary minor heat generation portion includes a major heat generator that generates an increased amount of heat and a minor heat generator that generates a decreased amount of heat smaller than the increased amount of heat generated by the major heat generator. The major heat generator has a width in an axial direction of the fixing rotator that is not smaller than 30 percent and not greater than 35 percent with respect to a width of the primary minor heat generation portion in the axial direction of the fixing rotator. A temperature detector is disposed opposite the minor heat generator of the primary heater to detect a temperature of the fixing rotator.

24 Claims, 17 Drawing Sheets

(56) References Cited

U.S. PATENT DOCUMENTS

| | | | | |
|---|---|---|---|---|
| 2011/0194870 | A1 | 8/2011 | Hase et al. | |
| 2011/0217057 | A1 | 9/2011 | Yoshinaga et al. | |
| 2011/0222929 | A1 | 9/2011 | Fujimoto et al. | |
| 2012/0051766 | A1 | 3/2012 | Ueno et al. | |
| 2012/0093532 | A1 | 4/2012 | Ishigaya et al. | |
| 2012/0177388 | A1 | 7/2012 | Imada et al. | |
| 2013/0177340 | A1 | 7/2013 | Kawata et al. | |
| 2013/0183072 | A1* | 7/2013 | Hase | G03G 15/2053 399/329 |
| 2013/0189008 | A1 | 7/2013 | Ishii et al. | |
| 2013/0209147 | A1 | 8/2013 | Ogawa et al. | |
| 2013/0251430 | A1 | 9/2013 | Fujimoto et al. | |
| 2014/0010578 | A1 | 1/2014 | Ishigaya et al. | |
| 2014/0016972 | A1 | 1/2014 | Seshita et al. | |
| 2014/0072355 | A1 | 3/2014 | Tamaki et al. | |
| 2014/0079424 | A1 | 3/2014 | Ikebuchi et al. | |
| 2014/0079453 | A1 | 3/2014 | Arai et al. | |
| 2014/0219672 | A1 | 8/2014 | Samei et al. | |
| 2014/0219673 | A1 | 8/2014 | Yamamoto et al. | |
| 2014/0227001 | A1 | 8/2014 | Kishi et al. | |
| 2014/0270820 | A1 | 9/2014 | Saito et al. | |
| 2014/0270831 | A1 | 9/2014 | Yoshinaga et al. | |
| 2014/0270833 | A1 | 9/2014 | Yuasa et al. | |
| 2014/0270872 | A1 | 9/2014 | Tamaki et al. | |
| 2014/0341623 | A1 | 11/2014 | Arai et al. | |
| 2014/0341624 | A1 | 11/2014 | Arai et al. | |
| 2014/0341625 | A1 | 11/2014 | Imada et al. | |
| 2014/0341626 | A1 | 11/2014 | Mimbu et al. | |
| 2014/0341627 | A1 | 11/2014 | Yoshikawa et al. | |
| 2014/0356036 | A1 | 12/2014 | Shimokawa et al. | |
| 2014/0356037 | A1 | 12/2014 | Shimokawa et al. | |
| 2014/0356038 | A1 | 12/2014 | Arai et al. | |
| 2015/0023705 | A1 | 1/2015 | Kawata et al. | |
| 2015/0050046 | A1 | 2/2015 | Honda et al. | |
| 2015/0055993 | A1 | 2/2015 | Shoji | |
| 2015/0110531 | A1 | 4/2015 | Takagi et al. | |
| 2015/0160591 | A1 | 6/2015 | Hase et al. | |
| 2015/0168897 | A1 | 6/2015 | Ogawa et al. | |
| 2015/0177659 | A1 | 6/2015 | Ishigaya et al. | |
| 2015/0261149 | A1 | 9/2015 | Seshita et al. | |
| 2015/0261151 | A1 | 9/2015 | Ishigaya et al. | |
| 2015/0261157 | A1 | 9/2015 | Yamano et al. | |
| 2015/0268597 | A1 | 9/2015 | Arai et al. | |
| 2015/0355586 | A1 | 12/2015 | Fujimoto et al. | |
| 2015/0378290 | A1 | 12/2015 | Kawata et al. | |
| 2016/0033906 | A1 | 2/2016 | Ikebuchi et al. | |
| 2016/0033910 | A1 | 2/2016 | Shimokawa et al. | |
| 2016/0062286 | A1 | 3/2016 | Yoshiura et al. | |
| 2016/0116869 | A1 | 4/2016 | Saito et al. | |
| 2016/0124359 | A1 | 5/2016 | Ikebuchi et al. | |
| 2016/0147185 | A1 | 5/2016 | Hase et al. | |
| 2016/0154350 | A1 | 6/2016 | Saito et al. | |

FOREIGN PATENT DOCUMENTS

| | | |
|---|---|---|
| JP | 7-092852 | 4/1995 |
| JP | 2002-258646 | 9/2002 |
| JP | 2005-309467 | 11/2005 |
| JP | 2010-032631 | 2/2010 |
| JP | 2014-232645 | 12/2014 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application Nos. 2015-137769, filed on Jul. 9, 2015, and 2016-085141 filed on Apr. 21, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and an opposed rotator to press against the fixing rotator to form a fixing nip between the fixing rotator and the opposed rotator, through which a recording medium bearing a toner image is conveyed. A primary heater is disposed opposite the fixing rotator to heat the fixing rotator. The primary heater includes a primary major heat generation portion and a primary minor heat generation portion disposed adjacent to the primary major heat generation portion in an axial direction of the fixing rotator. The primary minor heat generation portion includes at least one major heat generator to generate an increased amount of heat. The major heat generator has a width in the axial direction of the fixing rotator that is not smaller than 30 percent and not greater than 35 percent with respect to a width of the primary minor heat generation portion in the axial direction of the fixing rotator. At least one minor heat generator is disposed adjacent to the major heat generator in the axial direction of the fixing rotator to generate a decreased amount of heat smaller than the increased amount of heat generated by the major heat generator. A secondary heater is disposed opposite the fixing rotator to heat the fixing rotator. The secondary heater includes a secondary major heat generation portion and a secondary minor heat generation portion disposed adjacent to the secondary major heat generation portion in the axial direction of the fixing rotator. A temperature detector is disposed opposite the minor heat generator of the primary heater to detect a temperature of the fixing rotator.

This specification further describes an improved fixing device. In one exemplary embodiment, the fixing device includes a fixing rotator rotatable in a predetermined direction of rotation and an opposed rotator to press against the fixing rotator to form a fixing nip between the fixing rotator and the opposed rotator, through which a recording medium bearing a toner image is conveyed. A primary heater is disposed opposite the fixing rotator to heat the fixing rotator. The primary heater includes a primary major heat generation portion and a primary minor heat generation portion disposed adjacent to the primary major heat generation portion in an axial direction of the fixing rotator. The primary minor heat generation portion includes a major heat generator to generate an increased amount of heat and a minor heat generator disposed adjacent to the major heat generator in the axial direction of the fixing rotator to generate a decreased amount of heat smaller than the increased amount of heat of the major heat generator. The minor heat generator has a width rate with respect to a width of the major heat generator in the axial direction of the fixing rotator that is not smaller than 1.50 and not greater than 1.90. A secondary heater is disposed opposite the fixing rotator to heat the fixing rotator. The secondary heater includes a secondary major heat generation portion and a secondary minor heat generation portion disposed adjacent to the secondary major heat generation portion in the axial direction of the fixing rotator. A temperature detector is disposed opposite the fixing rotator to detect a temperature of the fixing rotator.

This specification further describes an improved fixing device. In one exemplary embodiment, the fixing device includes a fixing rotator rotatable in a predetermined direction of rotation and an opposed rotator to press against the fixing rotator to form a fixing nip between the fixing rotator and the opposed rotator, through which a recording medium bearing a toner image is conveyed. A heater is disposed opposite the fixing rotator to heat the fixing rotator. The heater includes at least one heat generator and at least one non-heat generator arranged alternately with the heat generator in an axial direction of the fixing rotator. A temperature detector is disposed opposite the non-heat generator to detect a temperature of the fixing rotator. The temperature detector is disposed downstream from the fixing nip and upstream from a heating position on the fixing rotator in the direction of rotation of the fixing rotator. At the heating position, the heater is spaced apart from the fixing rotator with a decreased interval between the heater and the fixing rotator.

This specification further describes an improved image forming apparatus. In one exemplary embodiment, the image forming apparatus includes the fixing device described above.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
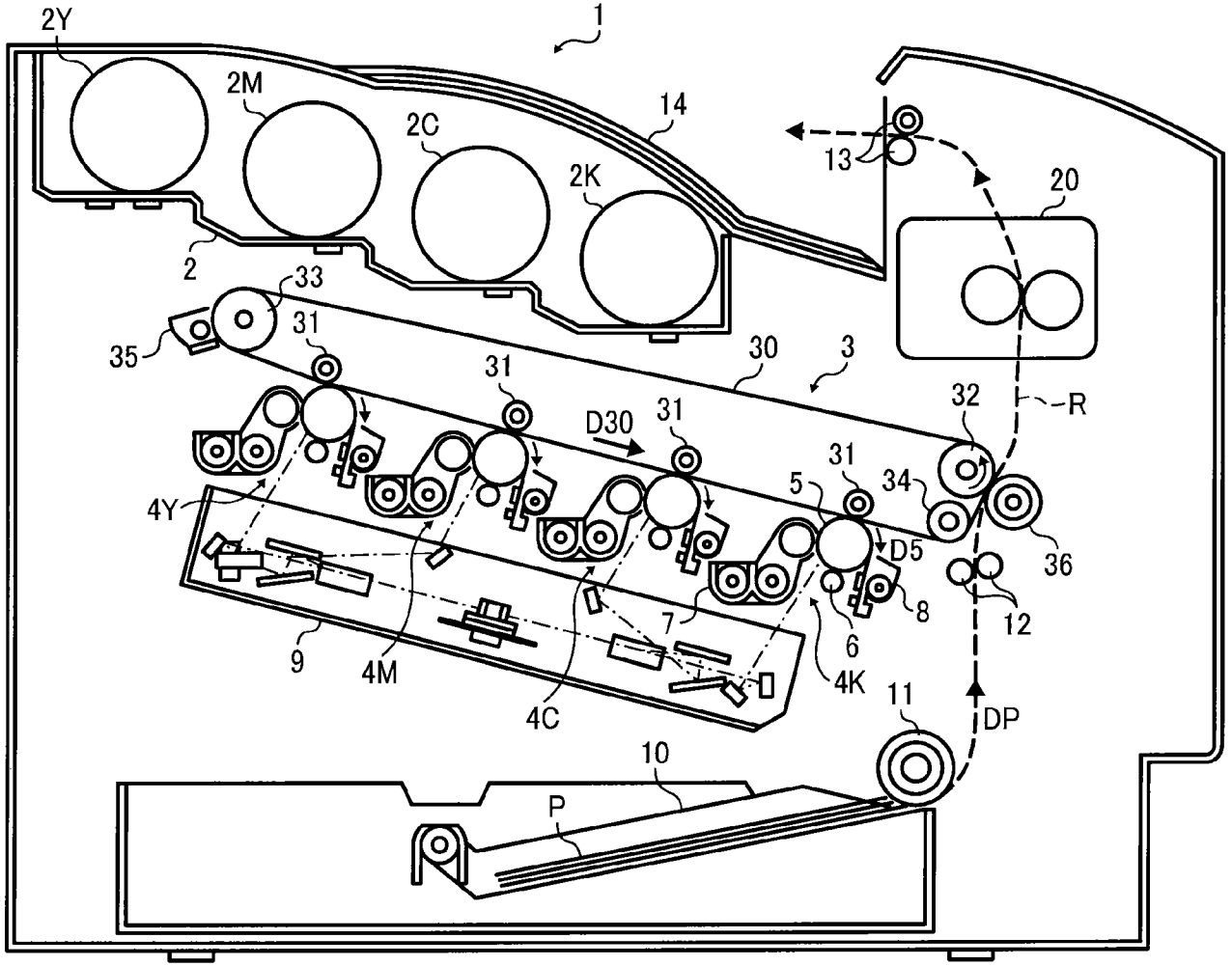
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms a color toner image on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

It is to be noted that, in the drawings for explaining exemplary embodiments of this disclosure, identical reference numerals are assigned as long as discrimination is possible to components such as members and component parts having an identical function or shape, thus omitting description thereof once it is provided.

As illustrated in FIG. 1, the image forming apparatus 1 is a color laser printer including four image forming devices 4Y, 4M, 4C, and 4K situated in a center portion thereof. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, they have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply disposed inside the image forming apparatus 1 that applies a predetermined direct current (DC) voltage and/or a predetermined alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply that applies a predetermined direct current (DC) voltage and/or a predetermined alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a timing roller pair conveys the sheet P conveyed from the feed roller 11 toward the secondary transfer nip at a proper time.

The conveyance path R is further provided with a fixing device 20 located above the secondary transfer nip, that is, downstream from the secondary transfer nip in the sheet conveyance direction DP. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting full color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 halts the sheet P temporarily.

Thereafter, the registration roller pair 12 resumes rotation at a predetermined time to convey the sheet P to the secondary transfer nip at a time when the full color toner image formed on intermediate transfer belt 30 reaches the secondary transfer nip. The secondary transfer roller 36 is applied with a transfer voltage having a polarity opposite a polarity of the charged yellow, magenta, cyan, and black toners constituting the full color toner image formed on the intermediate transfer belt 30, thus creating a transfer electric field at the secondary transfer nip. Thus, the yellow, magenta, cyan, and black toner images constituting the full color toner image are secondarily transferred from the intermediate transfer belt 30 onto the sheet P collectively by the transfer electric field created at the secondary transfer nip. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
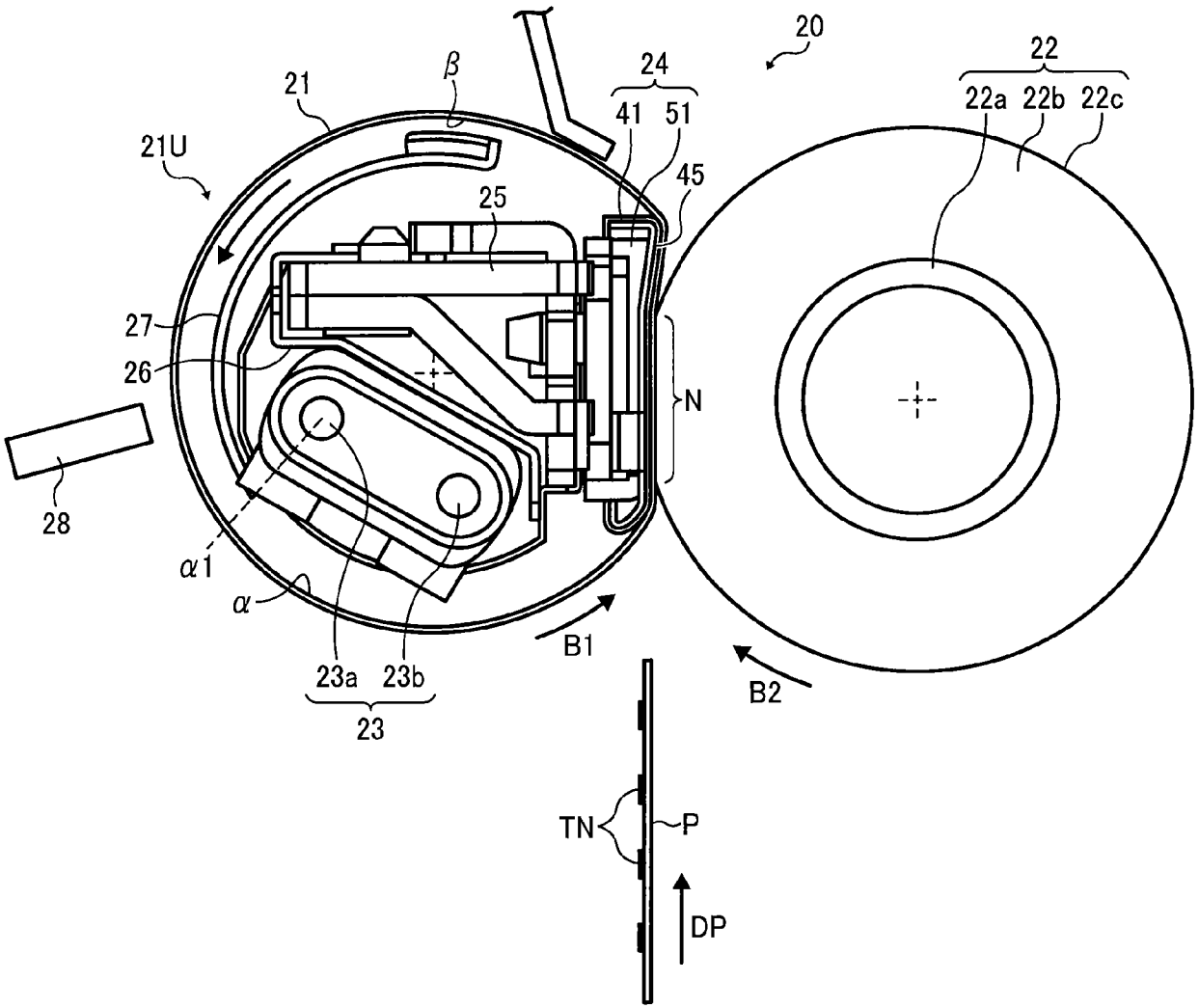
FIG. 2 is a schematic vertical cross-sectional view of a fixing device according to a first exemplary embodiment of the present disclosure that is incorporated in the image forming apparatus illustrated in FIG. 1.

Referring to FIG. 2, a description is provided of a construction of the fixing device 20 according to a first exemplary embodiment that is incorporated in the image forming apparatus 1 having the construction described above.

FIG. 2 is a vertical cross-sectional view of the fixing device 20. As illustrated in FIG. 2, the fixing device 20 (e.g., a fuser or a fusing unit) includes a fixing belt 21, a pressure roller 22, a halogen heater 23, a nip formation pad 24, a stay 25, a reflector 26, a heat shield 27, and a temperature sensor 28. The fixing belt 21 formed into a loop serves as a fixing rotator rotatable counterclockwise in FIG. 2 in a rotation direction B1. The pressure roller 22 serves as an opposed rotator that is rotatable clockwise in FIG. 2 in a rotation direction B2 to come into contact with an outer circumferential surface of the fixing belt 21 to form a fixing nip N therebetween, through which a sheet P bearing a toner image TN is conveyed. The halogen heater 23 serves as a heater or a heat source that heats the fixing belt 21. The nip formation pad 24 presses against the pressure roller 22 via the fixing belt 21 to form the fixing nip N between the fixing belt 21 and the pressure roller 22. The stay 25 serves as a support that supports the nip formation pad 24. The reflector 26 reflects light or heat radiated from the halogen heater 23 to the fixing belt 21. The heat shield 27 shields the fixing belt 21 from light or heat radiated from halogen heater 23. The temperature sensor 28 serves as a temperature detector that detects the temperature of the outer circumferential surface of the fixing belt 21. The fixing belt 21 and the components disposed inside the loop formed by the fixing belt 21, that is, the halogen heater 23, the nip formation pad 24, the stay 25, the reflector 26, and the heat shield 27, may constitute a belt unit 21U separably coupled with the pressure roller 22.

A detailed description is now given of a construction of the fixing belt 21.

The fixing belt 21 is a flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated quickly to a predetermined fixing temperature at which the unfixed toner image TN is fixed on the sheet P. However, as the pressure roller 22 and the fixing belt 21 sandwich and press the unfixed toner image TN on the sheet P passing through the fixing nip N, slight surface asperities of the fixing belt 21 may be transferred onto the toner image TN on the sheet P, resulting in variation in gloss of the solid toner image TN. To address this problem, it is preferable that the fixing belt 21 incorporates the elastic layer having a thickness not smaller than about 100 micrometers. The elastic layer having the thickness not smaller than 100 micrometers elastically deforms to absorb slight surface asperities of the fixing belt 21, preventing variation in gloss of the toner image TN on the sheet P.

In order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm. Additionally, the loop diameter of the fixing belt 21 may not be greater than 30 mm.

According to this exemplary embodiment, the pressure roller 22 has a diameter in a range of from 20 mm to 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22.

A description is provided of a configuration of a plurality of belt holders 40.

Figure 3:
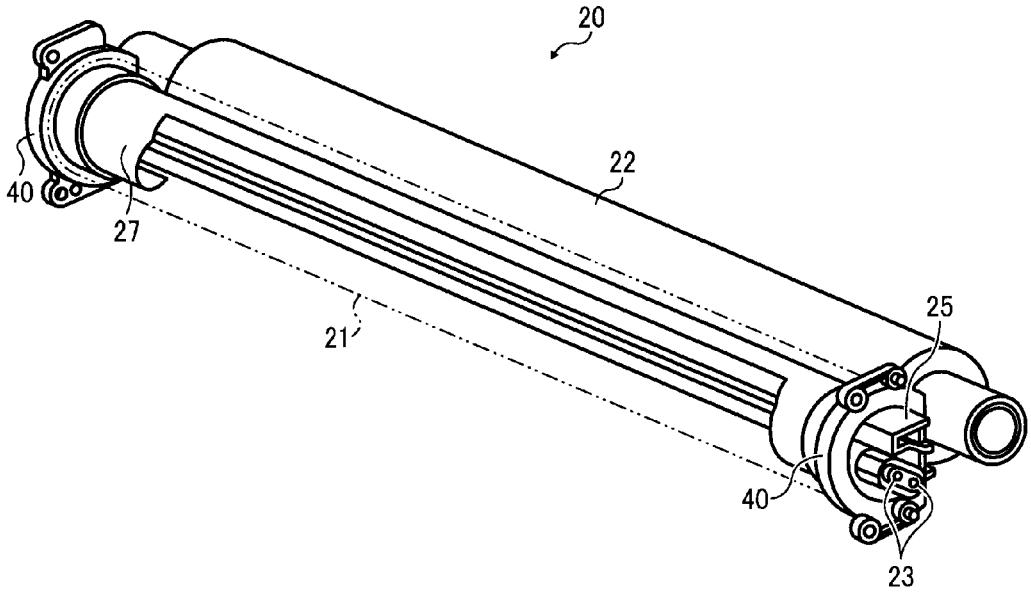
FIG. 3 is a partial perspective view of the fixing device depicted in FIG. 2.

FIG. 3 is a partial perspective view of the fixing device 20. As illustrated in FIG. 3, the fixing device 20 further includes the plurality of belt holders 40 disposed opposite the inner circumferential surface of the fixing belt 21 at both lateral ends of the fixing belt 21 in an axial direction thereof, respectively. The belt holders 40, disposed at both lateral ends of the fixing belt 21 in the axial direction thereof parallel to an axial direction of the pressure roller 22, respectively, rotatably support the fixing belt 21. Basically, no other component supports the fixing belt 21. That is, the fixing belt 21 is not looped over or stretched taut across a roller or the like. The pair of belt holders 40, the halogen heater 23, and the stay 25 are mounted on or secured to a pair of side plates of the fixing device 20 disposed at both lateral ends of the fixing device 20 in the axial direction of the fixing belt 21, respectively. A width of the stay 25 in a longitudinal direction thereof is greater than a width of the halogen heater 23 in a longitudinal direction thereof.

A slip ring is interposed between a lateral edge face of the fixing belt 21 and an opposed face of the belt holder 40 disposed opposite the lateral edge face of the fixing belt 21, thus serving as a protector that protects each lateral end of the fixing belt 21 in the axial direction thereof. Accordingly, even if the fixing belt 21 is skewed in the axial direction thereof, the slip ring prevents each lateral end of the fixing belt 21 from coming into direct contact with the belt holder 40, preventing abrasion and breakage of each lateral end of the fixing belt 21. The slip ring is loosely fitted onto an outer circumferential surface of the belt holder 40. Hence, as the lateral end of the fixing belt 21 contacts the slip ring, the slip ring is rotatable in accordance with rotation of the fixing belt 21. Alternatively, the slip ring may not be rotatable in accordance with rotation of the fixing belt 21 and therefore may be stationary. For example, the slip ring is made of heat resistant super engineering plastic such as polyether ether ketone (PEEK), polyphenylenesulfide (PPS), polyamide imide (PAI), and PTFE.

A detailed description is now given of a construction of the pressure roller 22.

As illustrated in FIG. 2, the pressure roller 22 is constructed of a cored bar 22*a*; an elastic layer 22*b* coating the cored bar 22*a* and made of rubber such as silicone rubber foam, silicone rubber, and fluoro rubber; and a release layer 22*c* coating the elastic layer 22*b* and made of PFA, PTFE, or the like. A pressurization assembly presses the pressure roller 22 against the nip formation pad 24 via the fixing belt 21 to form the fixing nip N between the fixing belt 21 and the pressure roller 22. The pressure roller 22 pressingly contacting the fixing belt 21 deforms the elastic layer 22*b* of the pressure roller 22 at the fixing nip N formed between the pressure roller 22 and the fixing belt 21, thus defining the fixing nip N having a predetermined length in the sheet conveyance direction DP.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

According to this exemplary embodiment, the pressure roller 22 is a solid roller. Alternatively, the pressure roller 22 may be a hollow roller. In this case, a heater such as a halogen heater may be disposed inside the hollow roller. The elastic layer 22*b* may be made of solid rubber. Alternatively, if no heater is situated inside the pressure roller 22, the elastic layer 22*b* may be made of sponge rubber. The sponge rubber is more preferable than the solid rubber because the sponge rubber has an increased insulation that draws less heat from the fixing belt 21.

A detailed description is now given of a configuration of the halogen heater 23.

The halogen heater 23 is disposed opposite the inner circumferential surface of the fixing belt 21 and upstream from the fixing nip N in the sheet conveyance direction DP so that the halogen heater 23 heats a circumferential span of the fixing belt 21 other than the fixing nip N in a circumferential direction, that is, the rotation direction B1, of the fixing belt 21. The power supply situated inside the image forming apparatus 1 supplies power to the halogen heater 23 so that the halogen heater 23 heats the fixing belt 21. A controller (e.g., a processor), that is, a central processing unit (CPU) provided with a random-access memory (RAM) and a read-only memory (ROM), for example, operatively connected to the halogen heater 23 and the temperature sensor 28 controls the halogen heater 23 based on the temperature of the surface of the fixing belt 21 detected by the temperature sensor 28. Thus, the temperature of the fixing belt 21 is adjusted to a desired fixing temperature. Instead of the temperature sensor 28 that detects the temperature of the fixing belt 21, a temperature sensor that detects the temperature of the pressure roller 22 may be disposed opposite the pressure roller 22 so that the temperature of the fixing belt 21 is estimated based on a temperature of the pressure roller 22 detected by the temperature sensor. The temperature sensor 28 is disposed opposite a center span of the fixing belt 21 in the axial direction. Another temperature sensor that detects the temperature of the surface of the fixing belt 21 is disposed opposite a lateral end span of the fixing belt 21 in the axial direction thereof.

The halogen heater 23 includes two heaters, that is, a lateral end heater 23*a* and a center heater 23*b*. The center heater 23*b* is disposed downstream from the lateral end heater 23*a* in the rotation direction B1 of the fixing belt 21 and is disposed closer to an entry to the fixing nip N than the lateral end heater 23*a* is. According to this exemplary embodiment, the halogen heater 23 includes the two heaters. Alternatively, the halogen heater 23 may include three or more heaters according to the sizes of the sheets P or the like available in the image forming apparatus 1. Alternatively, instead of the halogen heater 23, an induction heater (IH), a resistive heat generator, a carbon heater, or the like may be employed as a heater that heats the fixing belt 21.

A detailed description is now given of a configuration of the reflector 26.

The reflector 26 is secured to and supported by the stay 25 such that the reflector 26 is disposed opposite the halogen heater 23. The reflector 26 reflects light or heat radiated from the halogen heater 23 toward the fixing belt 21, suppressing conduction of heat from the halogen heater 23 to the stay 25 and the like and thereby heating the fixing belt 21 effectively and saving energy. The reflector 26 is made of aluminum, stainless steel, or the like. If the reflector 26 is constructed of an aluminum base treated with vapor deposition of silver having a decreased emissivity and an increased reflectance, the reflector 26 enhances heating efficiency in heating the fixing belt 21.

A detailed description is now given of a configuration of the heat shield 27.

The heat shield 27 is manufactured by contouring a metal plate having a thickness in a range of from 0.1 mm to 1.0 mm into an arch in cross-section along the inner circumferential surface of the fixing belt 21. The heat shield 27 is interposed between the halogen heater 23 and the fixing belt 21 and movable in the circumferential direction of the fixing belt 21. According to this exemplary embodiment, as illustrated in FIG. 2, the fixing belt 21 has a circumferential heated span α and a circumferential non-heated span β spanning in the circumferential direction thereof. The circumferential heated span α is disposed opposite the halogen heater 23 and heated directly by the halogen heater 23. The circumferential non-heated span β is disposed opposite components (e.g., the reflector 26, the stay 25, and the nip formation pad 24) interposed between the halogen heater 23 and the fixing belt 21 and secured to the side plates or the like and therefore is not heated by the halogen heater 23 directly. When the heat shield 27 is not requested to shield the fixing belt 21 from the halogen heater 23, the heat shield 27 moves to a retracted position where the heat shield 27 is disposed opposite the circumferential non-heated span β of the fixing belt 21. Conversely, when the heat shield 27 is requested to shield the fixing belt 21 from the halogen heater 23, the heat shield 27 moves to a shield position where the heat shield 27 is disposed opposite the circumferential heated span α of the fixing belt 21. FIG. 2 illustrates one example of the circumferential heated span α and the circumferential non-heated span β.

As the heat shield 27 rotates, the heat shield 27 changes the area of the circumferential heated span α of the fixing belt 21, adjusting an amount of heat radiated from the halogen heater 23 to the fixing belt 21. For example, even if a plurality of small sheets P is conveyed over the fixing belt 21 continuously, the heat shield 27 prevents overheating of a non-conveyance span of the fixing belt 21 where the small sheets S are not conveyed over the fixing belt 21 and therefore do not draw heat from the fixing belt 21, thus preventing thermal degradation and damage of the fixing belt 21. Since the heat shield 27 is requested to be heat resistant, the heat shield 27 is made of metal such as aluminum, iron, and stainless steel or ceramic.

A detailed description is now given of a construction of the nip formation pad 24.

The nip formation pad 24 is disposed inside the loop formed by the fixing belt 21 and disposed opposite the pressure roller 22 via the fixing belt 21.

The stay 25 supports the nip formation pad 24. Accordingly, even if the nip formation pad 24 receives pressure from the pressure roller 22, the nip formation pad 24 is not bent by the pressure and therefore produces a uniform nip length of the fixing nip N in the sheet conveyance direction DP throughout the entire width of the fixing belt 21 and the pressure roller 22 in the axial direction thereof. The stay 25 is made of metal having an increased mechanical strength, such as steel (e.g., stainless steel), to prevent bending of the nip formation pad 24. Alternatively, the stay 25 may be made of resin having a mechanical strength great enough to prevent bending of the nip formation pad 24.

A slide face of the nip formation portion 24 over which the fixing belt 21 slides mounts a low-friction sheet. As the fixing belt 21 rotates in the rotation direction B1, the inner circumferential surface of the fixing belt 21 slides over the low-friction sheet that reduces friction between the fixing belt 21 and the nip formation pad 24.

A description is provided of a construction of a comparative fixing device.

The comparative fixing device includes a heater constructed of a center heater and a lateral end heater. The center heater has a major heat generation span or a main heat generation span disposed at a center span of the center heater in a longitudinal direction of the heater. The lateral end heater has a major heat generation span disposed at each lateral end span of the lateral end heater in the longitudinal direction of the heater. When a small sheet having a width not greater than the major heat generation span of the center heater is conveyed through the comparative fixing device, the center heater is powered on. Conversely, when a large sheet having a width greater than the major heat generation span of the center heater is conveyed through the comparative fixing device, the center heater and the lateral end heater are powered on.

The heater is a halogen heater constructed of a glass tube and a filament wire constituting a filament disposed inside the glass tube. The halogen heater has a major heat generation span to heat a fixing rotator and a minor heat generation span not overlapping the major heat generation span. For example, the minor heat generation span is a center span of the lateral end heater in the longitudinal direction of the heater.

In the major heat generation span, the filament wire is coiled densely into a dense coil portion. The dense coil portion is supported by a holder (e.g., a ring supporter) secured to the glass tube. The glass tube supports the filament wire indirectly to allow the filament wire to retain a desired shape inside the glass tube.

On the other hand, the filament wire is substantially straight in the minor heat generation span to prevent the filament wire from generating heat. The substantially straight filament wire is hereinafter referred to as a minor heat generator or a non-heat generator. However, since the holder supports the filament wire to retain the desired shape even in the minor heat generation span, the filament wire is coiled to create a filament coil portion called a dead coil that is supported' y the holder. Since the substantially straight filament wire does not have a thickness great enough to allow the holder to support the filament wire, the filament coil portion supported by the holder is disposed in the minor heat generation span. However, the dead coil may generate heat slightly.

Accordingly, in the minor heat generation span, the dead coil attains an increased temperature. Conversely, an interval between the adjacent dead coils attains a decreased temperature, generating a temperature ripple (e.g., a temperature difference) throughout the entire width of the halogen heater in a longitudinal direction thereof. The temperature ripple may change according to energization of the halogen heater.

In order to adjust the temperature of the fixing rotator, a temperature sensor detects the temperature of the fixing rotator at a position where the fixing rotator attains a highest temperature.

However, if the halogen heater is controlled based on the highest temperature of the fixing rotator that is detected by the temperature sensor, a target temperature to which the fixing rotator is heated may be determined to be a temperature higher than a desired fixing temperature appropriate to fix a toner image on a sheet so as to prevent the fixing rotator from having a temperature lower than the desired fixing temperature, increasing energy consumption.

A description is provided of a construction of the halogen heater 23 in detail.

Figure 4:
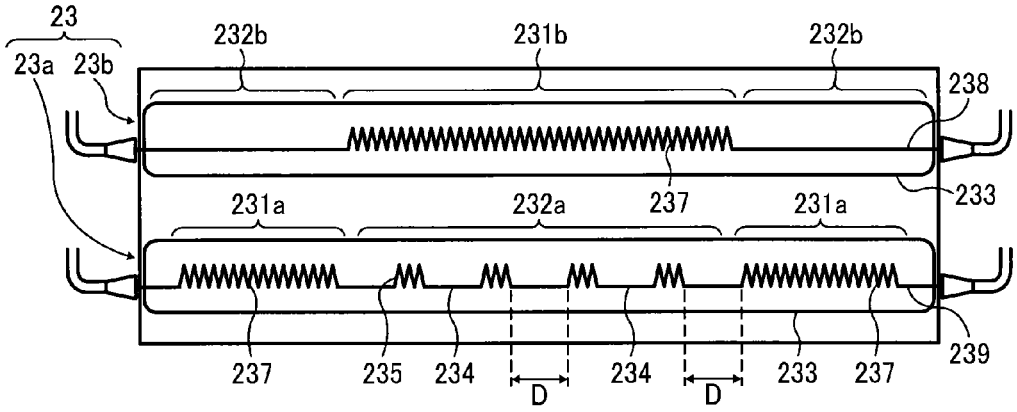
FIG. 4 is a plan view of a halogen heater incorporated in the fixing device depicted in FIG. 3.

FIG. 4 is a plan view of the halogen heater 23. As illustrated in FIG. 4, the halogen heater 23 includes the lateral end heater 23*a* serving as a primary heater and the center heater 23*b* serving as a secondary heater.

The lateral end heater 23*a* is a filament lamp including a glass tube 233 serving as a luminous tube and a single filament wire 239 disposed inside the glass tube 233. For example, the filament wire 239 is made of tungsten. The glass tube 233 is made of quartz glass.

The lateral end heater 23*a* has a primary major heat generation portion 231*a* disposed at each lateral end span of the lateral end heater 23*a* in the longitudinal direction of the halogen heater 23 parallel to the axial direction of the fixing belt 21. The primary major heat generation portion 231*a* of the lateral end heater 23*a* heats the fixing belt 21. The primary major heat generation portion 231*a* includes a dense coil portion 237 and a supporter described below that supports the dense coil portion 237. The dense coil portion 237 serves as a major heat generator or a major light emitter where the filament wire 239 is coiled densely.

The lateral end heater 23*a* has a primary minor heat generation portion 232*a* disposed at a center span of the lateral end heater 23*a* in the longitudinal direction of the halogen heater 23. The primary minor heat generation portion 232*a* is adjacent to the primary major heat generation portion 231*a* that heats the fixing belt 21 in the longitudinal direction of the halogen heater 23. The primary minor heat generation portion 232*a* includes a filament wire portion 234 and a dense coil portion 235. The filament wire portion 234 is constructed of the straight filament wire 239. The filament wire portion 234 serves as a minor heat generator or a minor light emitter where the filament wire 239 is coiled less densely than in the dense coil portion 235. The dense coil portion 235 serves as a major heat generator or a major light emitter where the filament wire 239 is coiled densely. The dense coil portion 235 is sandwiched between the adjacent filament wire portions 234 in the longitudinal direction of the halogen heater 23. A plurality of dense coil portions 235 is aligned with a predetermined interval between the adjacent dense coil portions 235 in the longitudinal direction of the halogen heater 23. A supporter serves as a holder supports or holds each dense coil portion 235 serving as a held portion. Alternatively, the filament wire portion 234 may be a non-dense coil portion where the filament wire 239 is coiled less densely than in the dense coil portions 235 and 237. For example, the filament wire portion 234 may be a rough helix.

Figure 5A:
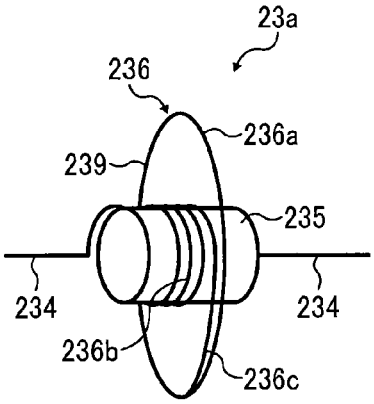
FIG. 5A is a partial perspective view of a lateral end heater incorporated in the halogen heater depicted in FIG. 4.
Figure 5B:
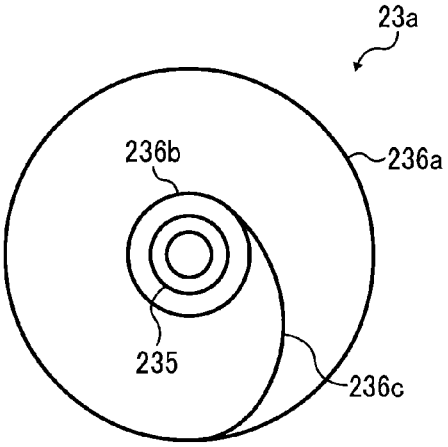
FIG. 5B is a cross-sectional view of the lateral end heater depicted in FIG. 5A.

FIG. 5A is a partial perspective view of the lateral end heater 23*a*. FIG. 5B is a cross-sectional view of the lateral end heater 23*a*. As illustrated in FIG. 5A, the lateral end heater 23*a* further includes a supporter 236 constructed of the single filament wire 239 made of tungsten, for example. The single filament wire 239 constituting the supporter 236 may be hereinafter referred to as a supporter wire. The supporter 236 has spring. The supporter 236 includes an increased diameter ring 236*a* contacting the glass tube 233 depicted in FIG. 4, a decreased diameter ring 236*b* supporting the filament (e.g., the dense coil portion 235), and an extension 236*c* bridging the increased diameter ring 236*a* and the decreased diameter ring 236*b*.

The increased diameter ring 236*a* is curved along an inner circumferential wall of the glass tube 233 to secure the supporter 236 to the glass tube 233. The decreased diameter portion 236*b* supports or holds the dense coil portion 235. Thus, the filament wire 239 disposed inside the lateral end heater 23*a* is supported by the glass tube 233 indirectly.

Since the primary minor heat generation portion 232*a* depicted in FIG. 4 is not intended to heat the fixing belt 21, the whole primary minor heat generation portion 232*a* may be constructed of the filament wire portion 234 to minimize an amount of heat generated by the primary minor heat generation portion 232*a*. However, in this case, the filament wire portion 234 does not have a thickness great enough to allow the supporter 236 to support the filament (e.g., the dense coil portion 235). Accordingly, the filament may not retain a desired shape inside the glass tube 233. For example, the filament may hang down. To address this circumstance, as described above, the primary minor heat generation portion 232*a* has the dense coil portion 235 constructed of a filament coil called a dead coil and supported by the supporter 236 so that the filament retains the desired shape inside the glass tube 233. As the filament retains the desired shape inside the glass tube 233, the filament is situated stably at a center of the glass tube 233 in a diametrical direction of the glass tube 233. Although FIGS. 5A and 5B illustrate the supporter 236 that supports the dense coil portion 235, the supporter 236 similarly supports the dense coil portion 237 in the primary major heat generation portion 231*a* of the lateral end heater 23*a* and in a secondary major heat generation portion 231*b* of the center heater 23*b*.

As illustrated in FIG. 4, the center heater 23*b* has the secondary major heat generation portion 231*b* disposed at a center span of the center heater 23*b* in the longitudinal direction of the halogen heater 23 and a secondary minor heat generation portion 232*b* disposed at each lateral end span of the center heater 23*b* in the longitudinal direction of the halogen heater 23. The center heater 23*b* is a partial heater including a metallic cored bar addressing short circuit, instead of the dense coil portion 235, in the secondary minor heat generation portion 232*b* so as to retain a desired shape of the filament wire 239.

Like the primary major heat generation portion 231*a* of the lateral end heater 23*a*, the secondary major heat generation portion 231*b* of the center heater 23*b* has the dense coil portion 237 extending in the longitudinal direction of the halogen heater 23 and a plurality of supporters aligned in the longitudinal direction of the halogen heater 23 with an interval between the adjacent supporters.

The secondary minor heat generation portion 232*b* has the above-described cored bar extending throughout the entire span of the secondary minor heat generation portion 232*b* in the longitudinal direction of the halogen heater 23. The filament wire 239 is coiled around the cored bar helically. The supporter is curved along the inner circumferential wall of the glass tube 233 to support the cored bar. Thus, the filament wire 239 is supported by the glass tube 233 indirectly, retaining the desired shape of the filament wire 239 inside the glass tube 233. Alternatively, a single cored bar addressing short circuit may be situated inside the glass tube 233 and extended throughout the entire width of the glass tube 233 in the longitudinal direction of the halogen heater 23. The filament wire 239 may be coiled around the cored bar densely in the secondary major heat generation portion 231*b* to produce a dense coil portion.

It is to be noted that FIG. 4 and subsequent drawings properly omit illustration and description of the supporter 236 incorporated in the lateral end heater 23*a* and the center heater 23*b*.

As illustrated in FIG. 4, the primary major heat generation portion 231*a* of the lateral end heater 23*a* that has the dense coil portion 237 where the filament wire 239 is coiled densely mainly heats the fixing belt 21. However, the filament wire 239 and the like of the dense coil portion 235 disposed in the primary minor heat generation portion 232*a* also generate heat, heating the fixing belt 21 substantially.

Since the primary minor heat generation portion 232*a* includes the filament wire portion 234 and the dense coil portion 235, the density of the filament wire 239 is uneven in the longitudinal direction of the halogen heater 23. Accordingly, the amount of heat generated in the primary minor heat generation portion 232*a* varies in the longitudinal direction of the halogen heater 23, heating the fixing belt 21 unevenly in the axial direction thereof.

A description is provided of variation in the amount of heat generated in the primary minor heat generation portion 232*a* in the longitudinal direction of the halogen heater 23, which results in variation in the amount of heat conducted to the fixing belt 21 in the axial direction thereof.

Figure 6A:
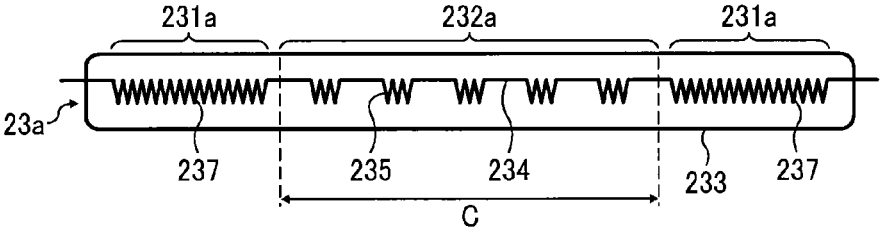
FIG. 6A is a plan view of the lateral end heater depicted in FIG. 5A incorporating an increased number of dense coil portions.
Figure 6B:
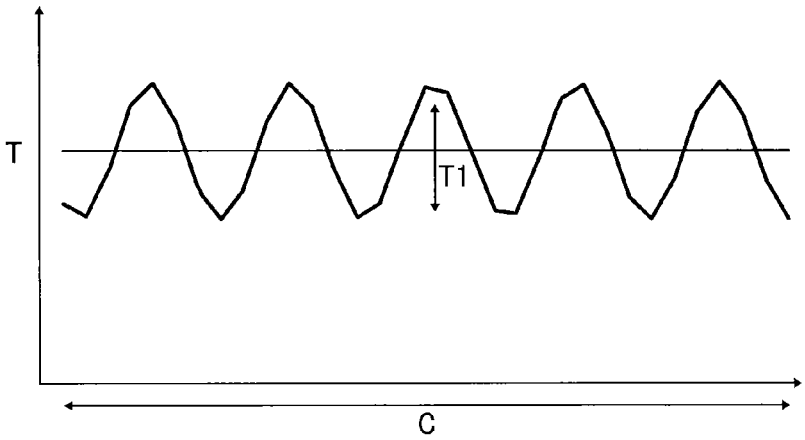
FIG. 6B is a graph illustrating a relation between a position in a span corresponding to a primary minor heat generation portion of the lateral end heater depicted in FIG. 6A and a temperature of a fixing belt.

FIG. 6A is a plan view of the lateral end heater 23*a*. FIG. 6B is a graph illustrating a relation between the position in a span C corresponding to the primary minor heat generation portion 232*a* of the lateral end heater 23*a* in the longitudinal direction of the halogen heater 23 and a temperature T of the fixing belt 21. That is, FIG. 6B illustrates a temperature distribution of the fixing belt 21 in the axial direction thereof. In FIG. 6B, an X-axis represents the position of the fixing belt 21 in the span C in the axial direction thereof. A Y-axis represents the temperature T of the fixing belt 21.

As illustrated in FIGS. 6A and 6B, in the primary minor heat generation portion 232*a*, the dense coil portion 235 is constructed of the filament wire 239 coiled densely and supported by the supporter 236 depicted in FIG. 5A. Accordingly, the temperature T of a portion of the fixing belt 21 that is disposed opposite the dense coil portion 235 is higher than the temperature T of a portion of the fixing belt 21 that is disposed opposite the filament wire portion 234. Consequently, the primary minor heat generation portion 232*a* generates a temperature difference T1 (hereinafter also referred to as a temperature ripple T1) in the temperature T of the fixing belt 21, that is, the amount of heat conducted to the fixing belt 21. As a result, the surface temperature of the fixing belt 21 creates a temperature distribution illustrated by a wave in FIG. 6B.

Figure 7A:
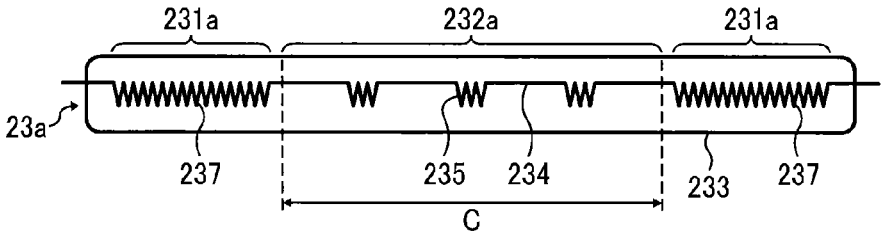
FIG. 7A is a plan view of the lateral end heater depicted in FIG. 5A incorporating a decreased number of the dense coil portions.
Figure 7B:
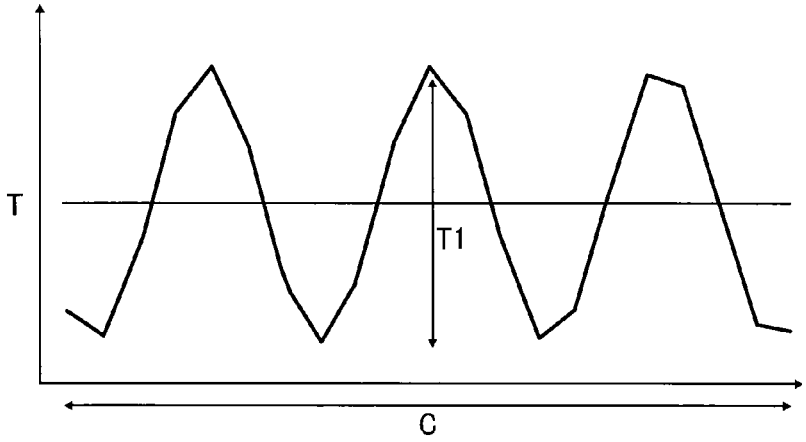
FIG. 7B is a graph illustrating a relation between the position in the span corresponding to the primary minor heat generation portion of the lateral end heater depicted in FIG. 6A and the temperature of the fixing belt.

FIG. 7A is a plan view of the lateral end heater 23*a* incorporating a decreased number of the dense coil portions 235. FIG. 7B is a graph illustrating a relation between the position in the span C and the temperature T of the fixing belt 21. As illustrated in FIG. 7A, the number of the supporters 236 and the dense coil portions 235 is reduced in the primary minor heat generation portion 232*a* to decrease the number of the dead coils situated in the primary minor heat generation portion 232*a*. Accordingly, redundant heat generation from the primary minor heat generation portion 232*a* is reduced, attaining energy saving inside the fixing device 20.

On the other hand, as illustrated in FIG. 7B, as the number of the dead coils decreases, an interval between the adjacent dead coils (e.g., an interval between the adjacent supporters 236 or an interval between the adjacent dense coil portions 235) increases and temperature decrease of the filament wire portion 234 progresses, thus increasing the temperature difference between the temperature of the dense coil portion 235 and the temperature of the filament wire portion 234. Accordingly, the temperature ripple T1 in FIG. 7B is greater than the temperature ripple T1 in FIG. 6B.

As described above, the number of the dense coil portions 235 is reduced and the interval between the adjacent dense coil portions 235 is increased to decrease the number of the dead coils and thereby reduce redundant heat generation of the lateral end heater 23*a*.

However, as the interval between the adjacent dense coil portions 235 increases, the temperature ripple T1 may increase. As the interval between the adjacent supporters 236 that support the filament increases, it may be difficult to retain the desired shape of the filament inside the glass tube 233. To address this circumstance, the interval between the adjacent dense coil portions 235, that is, a width of the filament wire portion 234 in the longitudinal direction of the halogen heater 23, is adjusted to a level that reduces redundant heat generation of the lateral end heater 23*a* and suppresses the temperature ripple T1 while retaining the desired shape of the filament inside the glass tube 233.

The interval between the adjacent dense coil portions 235 varies depending on the number of the dense coil portions 235 situated in the primary minor heat generation portion 232*a* and the width of each of the dense coil portions 235 in the longitudinal direction of the halogen heater 23. Accordingly, it is requested to adjust the width of each of the dense coil portions 235 appropriately. The dense coil portion 235 is requested to have a predetermined thickness (e.g., a predetermined density) and a predetermined width in the longitudinal direction of the halogen heater 23 to allow the supporter 236 to support the dense coil portion 235. That is, the width of the dense coil portion 235 in the longitudinal direction of the halogen heater 23 is decreased as small as possible to reduce the number of the dead coils and therefore reduce redundant heat generation of the lateral end heater 23*a*. However, the dense coil portion 235 is requested to have a predetermined width in the longitudinal direction of the halogen heater 23 in view of tolerance during manufacturing to allow the supporter 236 to support the dense coil portion 235 precisely. In view of the circumstances described above, the width of the dense coil portion 235 in the longitudinal direction of the halogen heater 23 is in a range of from 4 mm to 7 mm. According to this exemplary embodiment, the width of the dense coil portion 235 in the longitudinal direction of the halogen heater 23 is 6 mm.

According to this exemplary embodiment, a width of the primary minor heat generation portion 232*a* in the longitudinal direction of the halogen heater 23 is 214 mm to correspond to a width of an A4 size sheet in portrait orientation. An interval D depicted in FIG. 4 between the adjacent dense coil portions 235 is 11 mm to suppress the temperature ripple T1 and retain the desired shape of the filament. Twelve dense coil portions 235 each of which has the width of 6 mm in the longitudinal direction of the halogen heater 23 is disposed in the primary minor heat generation portion 232*a* having the width of 214 mm in the longitudinal direction of the halogen heater 23 with the interval D of 11 mm between the adjacent dense coil portions 235 in the longitudinal direction of the halogen heater 23. The width of the dense coil portion 235 and the interval D, that is, the width of the filament wire portion 234, generate slight error such as tolerance of parts. Accordingly, the above-described width of each of the dense coil portion 235 and the interval D may fluctuate slightly. The supporter 236 supports the dense coil portion 235. An interval in a range of from about 16 mm to about 17 mm is provided between the adjacent supporters 236 in the longitudinal direction of the halogen heater 23. The interval between the adjacent supporters 236 in the longitudinal direction of the halogen heater 23 is determined properly based on the width of the dense coil portion 235 in the longitudinal direction of the halogen heater 23, the density of the dense coil portion 235, the thickness of the filament, and the like.

The width of the dense coil portion 235 and the interval D, that is, the width of the filament wire portion 234, in the longitudinal direction of the halogen heater 23 are uniform to even variation in the temperature ripple T1 in the longitudinal direction of the halogen heater 23. Alternatively, the width of the dense coil portion 235 and the interval D, that is, the width of the filament wire portion 234, in the longitudinal direction of the halogen heater 23 may be partially decreased or increased.

As described above, in order to decrease redundant heat generation and suppress the temperature ripple T1, an occupation rate of the dense coil portion 235 with respect to the primary minor heat generation portion 232*a* in the longitudinal direction of the halogen heater 23 is not smaller than 30 percent and not greater than 35 percent. According to this exemplary embodiment, as described above, the twelve dense coil portions 235 each of which has the width of 6 mm in the longitudinal direction of the halogen heater 23 is provided in the primary minor heat generation portion 232*a* having the width of 214 mm in the longitudinal direction of the halogen heater 23. The occupation rate of the dense coil portion 235 with respect to the primary minor heat generation portion 232*a* in the longitudinal direction of the halogen heater 23 is about 34 percent. According to this exemplary embodiment, the secondary major heat generation portion 231*b* has a width of 214 mm in the longitudinal direction of the halogen heater 23 that corresponds to the width of the A4 size sheet in portrait orientation. Accordingly, the twelve dense coil portions 235 are provided in the primary minor heat generation portion 232*a*. Alternatively, the width of each of the secondary major heat generation portion 231*b* and the primary minor heat generation portion 232*a* may be determined based on the width of the sheet P. Accordingly, the number of the dense coil portions 235 disposed in the primary minor heat generation portion 232*a* may change within a range that satisfies the occupation rate of the dense coil portion 235 with respect to the primary minor heat generation portion 232*a*.

In order to decrease the amount of heat generated by the primary minor heat generation portion 232*a* and suppress the temperature ripple T1, a width rate of the interval D between the adjacent dense coil portions 235 with respect to the width of the dense coil portion 235 in the longitudinal direction of the halogen heater 23 is not smaller than 1.50 and not greater than 1.90. Preferably, as in this exemplary embodiment, the width rate of the interval D with respect to the width of the dense coil portion 235 is 1.83 to balance between the amount of heat generated in the primary minor heat generation portion 232*a* and the temperature ripple T1.

A comparative halogen heater includes fifteen dense coil portions 235 as the dead coils each of which has a width of 5.5 mm in a longitudinal direction of the comparative halogen heater with the interval D of 8 mm between the adjacent dense coil portions 235 in the primary minor heat generation portion 232*a* having the width of about 210 mm in the longitudinal direction of the comparative halogen heater. However, the above-described width of each of the dense coil portion 235 and the interval D may fluctuate slightly. In this case, the occupation rate of the dense coil portion 235 relative to the primary minor heat generation portion 232*a* in the longitudinal direction of the comparative halogen heater is about 39 percent. The interval D between the adjacent dense coil portions 235 is 1.45 as great as the width of the dense coil portion 235 in the longitudinal direction of the comparative halogen heater. Compared to the primary minor heat generation portion 232*a* of the comparative halogen heater, the primary minor heat generation portion 232*a* of the halogen heater 23 according to this exemplary embodiment attains the greater interval D between the adjacent dense coil portions 235 in the longitudinal direction of the halogen heater 23 within the range that reduces redundant heat generation from the primary minor heat generation portion 232*a* and suppresses the temperature ripple T1.

As illustrated in FIG. 2, the temperature sensor 28 is disposed downstream from an exit (e.g., a downstream end) of the fixing nip N and in proximity to and upstream from a heating position $\alpha$1 in the rotation direction B1 of the fixing belt 21. The temperature sensor 28 detects the temperature of the outer circumferential surface of the fixing belt 21 before the halogen heater 23 heats the fixing belt 21. The controller determines an amount of heat to be generated by the halogen heater 23 to heat the fixing belt 21 based on the detected temperature of the fixing belt 21.

However, as described above, as the temperature ripple T1 increases, the temperature of the fixing belt 21 detected by the temperature sensor 28 may vary substantially depending on the position where the temperature sensor 28 detects the temperature of the fixing belt 21. Accordingly, the controller may not determine the amount of heat to be generated by the halogen heater 23 precisely. For example, if the temperature sensor 28 detects the temperature of the fixing belt 21 at a position where the outer circumferential surface of the fixing belt 21 has an increased temperature, the controller may determine a decreased amount of heat to be generated by the halogen heater 23 that is lower than an appropriate amount of heat. Accordingly, the halogen heater 23 may not heat the fixing belt 21 sufficiently, causing cold offset. If the controller increases the amount of heat to be generated by the halogen heater 23 to prevent cold offset, the halogen heater 23 may heat the fixing belt 21 redundantly, wasting energy and degrading energy saving of the fixing device 20.

Figure 8:
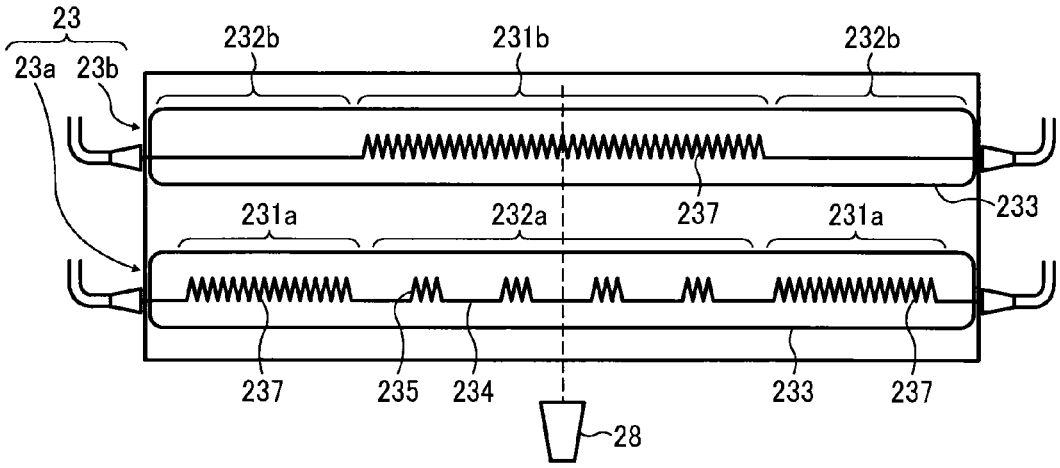
FIG. 8 is a plan view of the halogen heater and a temperature sensor incorporated in the fixing device depicted in FIG. 2.

To address this circumstance, the temperature sensor 28 is situated relative to the fixing belt 21 as illustrated in FIG. 8. FIG. 8 is a plan view of the halogen heater 23 and the temperature sensor 28. As illustrated in FIG. 8, the temperature sensor 28 is disposed opposite an intermediate position between the adjacent supporters 236, that is, an intermediate position between the adjacent dense coil portions 235, in the primary minor heat generation portion 232*a* of the lateral end heater 23*a* in the longitudinal direction of the halogen heater 23. That is, the temperature sensor 28 is disposed opposite a center or a vicinity of the center of the lateral end heater 23*a*, that is, a center or a vicinity of the center of the fixing belt 21 in the axial direction thereof.

The amount of heat conducted to the fixing belt 21 decreases at the intermediate position between the adjacent dense coil portions 235 in the longitudinal direction of the halogen heater 23 as illustrated with a wave trough of a temperature curve in FIG. 6B. According to this exemplary embodiment, while the sheet P is conveyed over the fixing belt 21, the sheet P is centered in the axial direction of the fixing belt 21. Hence, a center of the sheet P in a width direction thereof parallel to the axial direction of the fixing belt 21 is disposed opposite the center of the lateral end heater 23*a* in the longitudinal direction of the halogen heater 23. As the sheet P is conveyed over the fixing belt 21, heat is conducted from the outer circumferential surface of the fixing belt 21 to the sheet P, decreasing the temperature of the outer circumferential surface of the fixing belt 21 in a conveyance span of the fixing belt 21 where the sheet P is conveyed.

To address this circumstance, the temperature sensor 28 is disposed opposite the center span of the fixing belt 21 in the axial direction thereof where the temperature of the outer circumferential surface of the fixing belt 21 is susceptible to temperature decrease most so as to detect the temperature of the fixing belt 21. The temperature ripple T1 that may appear in the axial direction of the fixing belt 21 is measured in advance. The controller determines the amount of heat to be generated by the halogen heater 23 based on the measured temperature ripple T1 so that the fixing belt 21 attains a desired fixing temperature high enough to fix the toner image TN on the sheet P even in the center span of the fixing belt 21 in the axial direction thereof where the temperature sensor 28 detects the temperature of the fixing belt 21 and that the fixing belt 21 does not overheat to a temperature higher than the desired fixing temperature even at a position on the fixing belt 21 where the fixing belt 21 is heated most to a highest temperature.

As described above, the controller determines the amount of heat to be generated by the halogen heater 23 based on a lowest temperature of the fixing belt 21. Accordingly, the fixing belt 21 attains the desired fixing temperature even at the position on the fixing belt 21 where the fixing belt 21 is susceptible to the lowest temperature, preventing cold offset. Additionally, the halogen heater 23 does not heat the fixing belt 21 redundantly to prevent cold offset, achieving energy saving of the fixing device 20.

As illustrated in FIG. 2, the halogen heater 23 heats the fixing belt 21 at the heating position α1 on the surface of the fixing belt 21 where the heat shield 27 or the like does not shield the fixing belt 21 from the halogen heater 23. The halogen heater 23 is spaced apart from the fixing belt 21 with a smallest interval therebetween at the heating position α1.

The temperature sensor 28 situated as described above detects the temperature of the outer circumferential surface of the fixing belt 21 after the sheet P conveyed through the fixing nip N draws heat from the fixing belt 21 and immediately before the halogen heater 23 heats the fixing belt 21. Accordingly, the controller determines the amount of heat to be generated by the halogen heater 23 to heat the fixing belt 21 precisely.

In order to determine the amount of heat to be generated by the halogen heater 23 precisely, it is preferable to locate the temperature sensor 28 at the position illustrated in FIG. 2 where the temperature sensor 28 is disposed upstream from the halogen heater 23 in the rotation direction B1 of the fixing belt 21 so that the temperature sensor 28 detects the temperature of the fixing belt 21 immediately before the halogen heater 23 heats the fixing belt 21. Alternatively, the temperature sensor 28 may be disposed at other positions that are downstream from the fixing nip N and upstream from the heating position α1 in the rotation direction B1 of the fixing belt 21. However, according to this exemplary embodiment, the temperature sensor 28 is disposed in proximity to the heating position α1 and the halogen heater 23 so that the temperature sensor 28 also serves as a safety device of the fixing device 20. For example, even if the amount of heat generated by the halogen heater 23 increases excessively due to some failure, the temperature sensor 28 detects the failure and allows the controller to perform emergency measures such as powering off of the fixing device 20.

According to this exemplary embodiment, the temperature sensor 28 is disposed opposite substantially the center of the lateral end heater 23*a* in the longitudinal direction of the halogen heater 23 as illustrated in FIG. 8. Alternatively, the temperature sensor 28 may be situated at other positions as long as the temperature sensor 28 is disposed opposite substantially the center of the fixing belt 21 in the axial direction thereof where the sheet P is conveyed over the fixing belt 21. It is preferable that the temperature sensor 28 is disposed opposite substantially the center of the fixing belt 21 in the axial direction thereof where the sheet P is conveyed. Alternatively, the temperature sensor 28 may be disposed opposite the intermediate position between the adjacent dense coil portions 235 in the longitudinal direction of the halogen heater 23, thus attaining the advantages described above. For example, if the fixing device 20 is configured to convey the sheet P such that one lateral edge of the sheet P in the width direction thereof is defined along one lateral end of the fixing belt 21 in the axial direction thereof, the center of the sheet P in the width direction thereof varies depending on the size of the sheet P. Accordingly, the position of the temperature sensor 28 is adjusted properly. For example, the temperature sensor 28 is disposed opposite substantially an axial span of the fixing belt 21 in the axial direction thereof that corresponds to substantially the center of the sheet P of any one of a plurality of sizes available in the fixing device 20.

Figure 9:
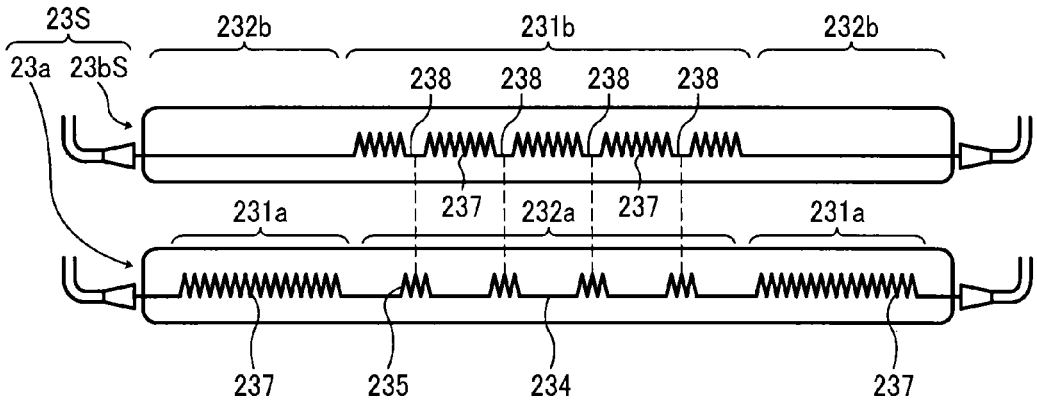
FIG. 9 is a plan view of a halogen heater incorporating a center heater having a filament wire portion as a variation of the halogen heater depicted in FIG. 8.

As illustrated in FIGS. 4 and 8, the dense coil portion 237 of the primary major heat generation portion 231*a* is contiguous to the dense coil portion 237 of the secondary major heat generation portion 231*b* in the longitudinal direction of the halogen heater 23. Alternatively, as illustrated in FIG. 9, a filament wire portion 238 may be interposed between the adjacent dense coil portions 237 in a longitudinal direction of a halogen heater 23S. FIG. 9 is a plan view of the halogen heater 23S incorporating a center heater 23*b*S having the filament wire portion 238. As illustrated in FIG. 9, the filament wire portion 238 has a decreased length in the longitudinal direction of the halogen heater 23S. Thus, the dense coil portions 237 are not contiguous in the longitudinal direction of the halogen heater 23S. Instead of the filament wire portion 238 disposed between the adjacent dense coil portions 237, a non-dense coil portion where the filament wire 239 is coiled less densely than in the dense coil portion 237 may be disposed between the adjacent dense coil portions 237 in the longitudinal direction of the halogen heater 23S.

The filament wire portion 238 and the non-dense coil portion are disposed in the secondary major heat generation portion 231*b* to reduce the weight of the filament wire 239 in the secondary major heat generation portion 231*b* and the weight of the filament supported by the supporter 236, thus increasing the interval between the adjacent supporters 236 in the secondary major heat generation portion 231*b* in the longitudinal direction of the halogen heater 23S.

Accordingly, even if the filament wire portion 238 and the non-dense wire portion are disposed in the secondary major heat generation portion 231*b*, if a width of each of the filament wire portion 238 and the non-dense wire portion is sufficiently smaller than a width of the dense coil portion 237 in the longitudinal direction of the halogen heater 23S, the filament wire portion 238 and the non-dense wire portion barely generate the temperature ripple T1. Additionally, as illustrated in FIG. 9, the dense coil portion 235 of the lateral end heater 23*a* is disposed opposite the filament wire portion 238 of the center heater 23*b*S, decreasing the temperature ripple T1 in the axial direction of the fixing belt 21 to some extent. For example, as illustrated in FIG. 9, the filament wire portion 238 serving as a decreased temperature portion of the secondary major heat generation portion 231*b* of the center heater 23*b*S is disposed opposite the dense coil portion 235 serving as an increased temperature portion of the primary minor heat generation portion 232*a* of the lateral end heater 23*a*, thus partially offsetting temperature difference in the longitudinal direction of the halogen heater 23S and decreasing the temperature ripple T1 in the axial direction of the fixing belt 21.

A description is provided of temperature decrease at each lateral end of the center heater 23*b*S in the longitudinal direction of the halogen heater 23S.

Since the dense coil portion 235 is not disposed in the secondary minor heat generation portion 232*b* of the center heater 23*b*S, the secondary minor heat generation portion 232*b* barely generates heat and thereby barely generates the temperature ripple T1. On the other hand, since the secondary minor heat generation portion 232*b* barely generates heat, the center heater 23*b*S suffers from sharp temperature decrease at a boundary between the secondary minor heat generation portion 232*b* and the secondary major heat generation portion 231*b*. Accordingly, compared to a configuration in which a non-partial heater is used as the lateral end heater 23*a* and the center heater 23*b*S, the halogen heater 23S may not heat the fixing belt 21 sufficiently at the boundary between the secondary minor heat generation portion 232*b* and the secondary major heat generation portion 231*b* of the center heater 23*b*S and a boundary between the primary minor heat generation portion 232*a* and the primary major heat generation portion 231*a* of the lateral end heater 23*a*. Consequently, the halogen heater 23S may not heat the sheet P sufficiently to fix the toner image TN on the sheet P. For example, if a gap is created between the secondary major heat generation portion 231*b* of the center heater 23*b*S and the primary major heat generation portion 231*a* of the lateral end heater 23*a* in the longitudinal direction of the halogen heater 23S due to assembly error, variation in dimension of parts, and the like, the amount of heat generated by the halogen heater 23S may decrease substantially at the gap compared to other portions of the halogen heater 23S.

In order to address decrease in the amount of heat generated at the gap between the secondary major heat generation portion 231*b* of the center heater 23*b*S and the primary major heat generation portion 231*a* of the lateral end heater 23*a* in the longitudinal direction of the halogen heater 23S and temperature increase at each lateral end of the fixing belt 21 in the axial direction thereof where the sheet P is not conveyed over the fixing belt 21, according to this exemplary embodiment, the nip formation pad 24 depicted in FIG. 2 incorporates a thermal equalizer.

A description is provided of a construction of the nip formation pad 24.

As illustrated in FIG. 2, the nip formation pad 24 includes a base 51 serving as a decreased thermal conductivity conductor and a thermal equalizer 41 serving as an increased thermal conductivity conductor sandwiched between the base 51 and the fixing belt 21 at the fixing nip N.

A thermal conductivity of the thermal equalizer 41 is greater than a thermal conductivity of the base 51. The thermal equalizer 41 is on the right of the base 51 in FIG. 2 and abuts the fixing belt 21. The thermal equalizer 41 contacts the fixing belt 21 throughout the entire width of the fixing belt 21 in the axial direction thereof to conduct heat on the surface of the fixing belt 21 in the axial direction thereof, evening the temperature of the outer circumferential surface of the fixing belt 21.

For example, the thermal equalizer 41 is made of carbon nanotube having a thermal conductivity in a range of from 3,000 W/mK to 5,500 W/mK, graphite sheet having a thermal conductivity in a range of from 700 W/mK to 1,750 W/mK, silver having a thermal conductivity of 420 W/mK, copper having a thermal conductivity of 398 W/mK, aluminum having a thermal conductivity of 236 W/mK, steel electrolytic cold commercial (SECC), or the like. The thermal equalizer 41 has a thermal conductivity not smaller than 236 W/mK. For example, the base 51 is made of heat resistant resin such as polyether sulfone (PES), polyphenylene sulfide (PPS), liquid crystal polymer (LCP), polyether nitrile (PEN), polyamide imide (PAI), polyether ether ketone (PEEK), or the like.

Figure 10:
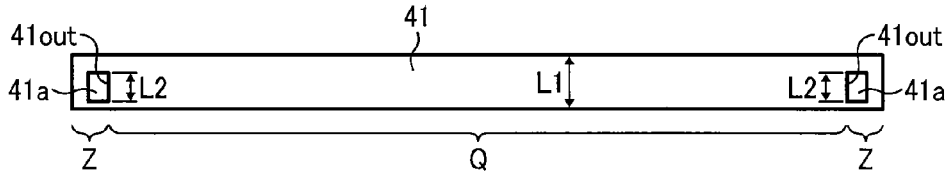
FIG. 10 is a plan view of a thermal equalizer incorporated in the fixing device depicted in FIG. 2.

FIG. 10 is a plan view of the thermal equalizer 41. As illustrated in FIG. 10, the thermal equalizer 41 includes an outboard edge 41 out that does not define an outermost end of the thermal equalizer 41 in a longitudinal direction thereof parallel to the axial direction of the fixing belt 21 but does define an inboard edge of a slot 41*a* disposed at each lateral end of the thermal equalizer 41 in the longitudinal direction thereof.

A description is provided of a reason of such definition of the outboard edge 41 out.

Each slot 41*a* of the thermal equalizer 41 positions the thermal equalizer 41 to the base 51 of the nip formation pad 24. As a projection serving as a positioner projecting from the base 51 is inserted into each slot 41*a* of the thermal equalizer 41, the thermal equalizer 41 is positioned to the base 51 in the longitudinal direction of the thermal equalizer 41.

The slot 41*a* decreases an area where the thermal equalizer 41 contacts the fixing belt 21, thus reducing heat conduction from a portion provided with the slot 41*a* outward in the longitudinal direction of the thermal equalizer 41. For example, as illustrated in FIG. 10, a length L2 of the slot 41*a* in the sheet conveyance direction DP is greater than a half of a length L1 of the thermal equalizer 41 in the sheet conveyance direction DP, decreasing the amount of heat conducted from the slot 41*a* outward in the longitudinal direction of the thermal equalizer 41. A center span portion Q spanning from one slot 41*a* to another slot 41*a* through a center of the thermal equalizer 41 in the longitudinal direction thereof serves mainly as a thermal conductor. Conversely, an outboard span portion Z disposed outboard from the outboard edge 41 out of each slot 41*a* in the longitudinal direction of the thermal equalizer 41, although the outboard span portion Z conducts heat slightly, achieves a decreased thermal conduction compared to the center span portion Q. Hence, the outboard span portion Z serves mainly as a positioner.

Accordingly, an outboard edge of the center span portion Q serving as the thermal conductor to equalize heat on the fixing belt 21 in the axial direction thereof, that is, the inboard edge of the slot 41*a* in the longitudinal direction of the thermal equalizer 41, defines the outboard edge 41 out of the thermal equalizer 41 in the longitudinal direction thereof. Unlike the thermal equalizer 41 according to this exemplary embodiment, if the length L2 of the slot 41*a* in the sheet conveyance direction DP is smaller than the half of the length L1 of the thermal equalizer 41 in the sheet conveyance direction DP, the outboard span portion Z disposed outboard from the slot 41*a* in the longitudinal direction of the thermal equalizer 41 serves mainly as a thermal conductor. Accordingly, an outboard end of the thermal equalizer 41 in the longitudinal direction thereof, including the outboard span portion Z disposed outboard from the slot 41*a* in the longitudinal direction of the thermal equalizer 41, defines the outboard edge 41 out.

Figure 11:
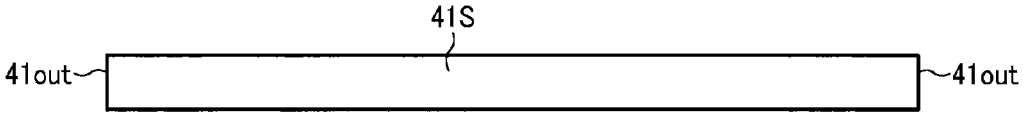
FIG. 11 is a plan view of a thermal equalizer as a variation of the thermal equalizer depicted in FIG. 10.

FIG. 11 is a plan view of a thermal equalizer 41S as a variation of the thermal equalizer 41 depicted in FIG. 10. As illustrated in FIG. 11, the thermal equalizer 41S does not incorporate the slot 41*a* that may serve as a positioner disposed at each lateral end of the thermal equalizer 41S in a longitudinal direction thereof. In this case, the thermal equalizer 41S attains a uniform contact length in the sheet conveyance direction DP in which the thermal equalizer 41S contacts the fixing belt 21 throughout the entire width of the thermal equalizer 41S in the longitudinal direction thereof. Thus, the entire thermal equalizer 41S serves as a thermal conductor. Accordingly, as illustrated in FIG. 11, an outboard edge of the thermal equalizer 41S in the longitudinal direction thereof defines the outboard edge 41 out of the thermal equalizer 41S in the longitudinal direction thereof.

Alternatively, instead of the nip formation pad 24 having a double-layer structure constructed of the base 51 and the thermal equalizer 41, a nip formation pad 24S having a triple-layer structure may be employed.

A description is provided of a construction of the nip formation pad 24S having the triple-layer structure.

Figure 12:
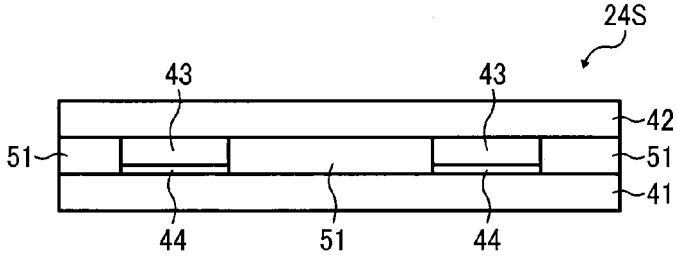
FIG. 12 is a cross-sectional view of a nip formation pad installable in the fixing device depicted in FIG. 2.
Figure 13:
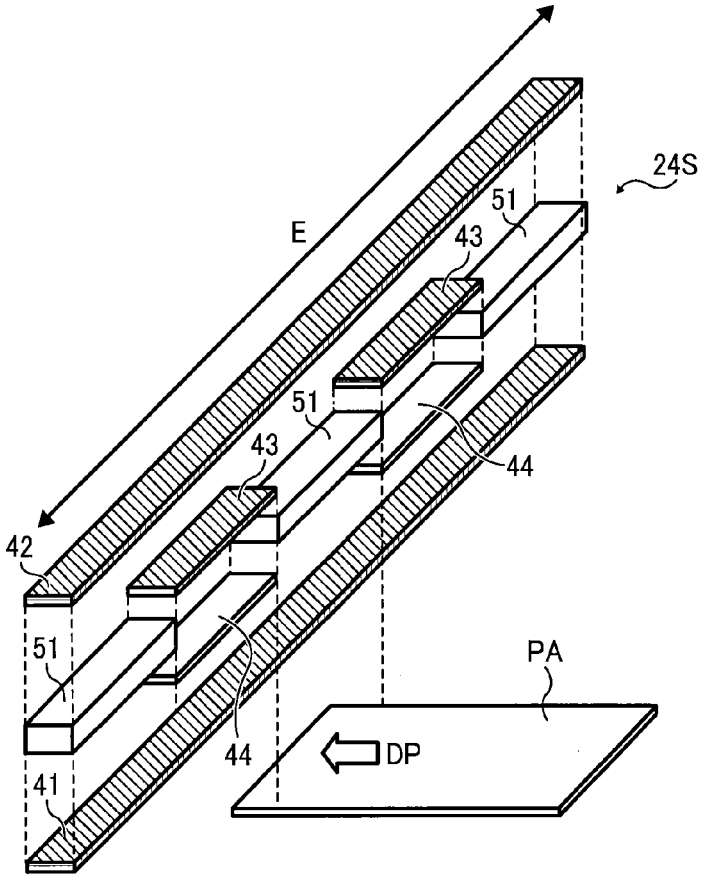
FIG. 13 is an exploded perspective view of the nip formation pad depicted in FIG. 12.

FIG. 12 is a cross-sectional view of the nip formation pad 24S. FIG. 13 is an exploded perspective view of the nip formation pad 24S. As illustrated in FIGS. 12 and 13, the nip formation pad 24S includes the thermal equalizer 41 serving as an increased thermal conductivity conductor, thermal absorbers 42 and 43, a resin layer 44, and the base 51 serving as a decreased thermal conductivity conductor.

A thermal conductivity of each of the thermal absorbers 42 and 43 is greater than a thermal conductivity of the base 51. For example, the thermal absorbers 42 and 43 are made of the above-described carbon nanotube used by the thermal equalizer 41. The thermal absorber 43 is disposed opposite the non-conveyance span of the fixing belt 21 where a small sheet P is not conveyed over the fixing belt 21. The non-conveyance span is disposed at each lateral end of the fixing belt 21 in the axial direction thereof and is susceptible to temperature increase described below. The thermal absorbers 42 and 43 facilitate conduction of heat vertically in FIG. 12 and horizontally in FIG. 2 in a thickness direction of the nip formation pad 24S. Accordingly, an absorption span of the nip formation pad 24S in the longitudinal direction thereof where the thermal absorber 43 is disposed facilitates conduction of heat in the thickness direction of the nip formation pad 24S compared to a span of the nip formation pad 24S in the longitudinal direction thereof where the base 51 is disposed, thus suppressing temperature increase or overheating of the fixing belt 21 in the absorption span. The thermal absorbers 42 and 43 compensate for shortage of the thermal capacity of the thermal equalizer 41. However, if each of the thermal absorbers 42 and 43 is thick excessively, the thermal absorbers 42 and 43 may facilitate conduction of heat excessively. To address this circumstance, the thermal absorbers 42 and 43 may be elongated in a longitudinal direction of the nip formation pad 24S compared to the thermal absorbers 42 and 43 illustrated in FIG. 12 or the thermal absorbers 42 and 43 may project from the base 51 in the circumferential direction of the fixing belt 21.

The resin layer 44 is sandwiched between the thermal equalizer 41 and the thermal absorber 43. The resin layer 44 is made of a material having a thermal conductivity smaller than that of the thermal equalizer 41 and the thermal absorbers 42 and 43. The thermal absorbers 42 and 43 conduct heat in the thickness direction of the nip formation pad 24S. However, the thermal absorbers 42 and 43 conduct heat excessively. Accordingly, the fixing belt 21 may suffer from excessive temperature decrease in an axial span of the fixing belt 21 where the thermal absorber 43 is disposed. To address this circumstance, the resin layer 44 is sandwiched between the thermal equalizer 41 and the thermal absorber 43, suppressing excessive conduction of heat in the thickness direction of the nip formation pad 24S.

Thus, the nip formation pad 24S is constructed of the plurality of materials having different thermal conductivities, respectively, that is layered in the thickness direction of the nip formation pad 24S.

As illustrated in FIG. 13, a width of the base 51 interposed between the two thermal absorbers 43 in the longitudinal direction of the nip formation pad 24S is substantially equal to a width of a minimum size sheet PA (e.g., an A6 size sheet) conveyed in the sheet conveyance direction DP.

A description is provided of a positional relation between the nip formation pad 24S having the triple-layer structure and the halogen heater 23.

Figure 14:
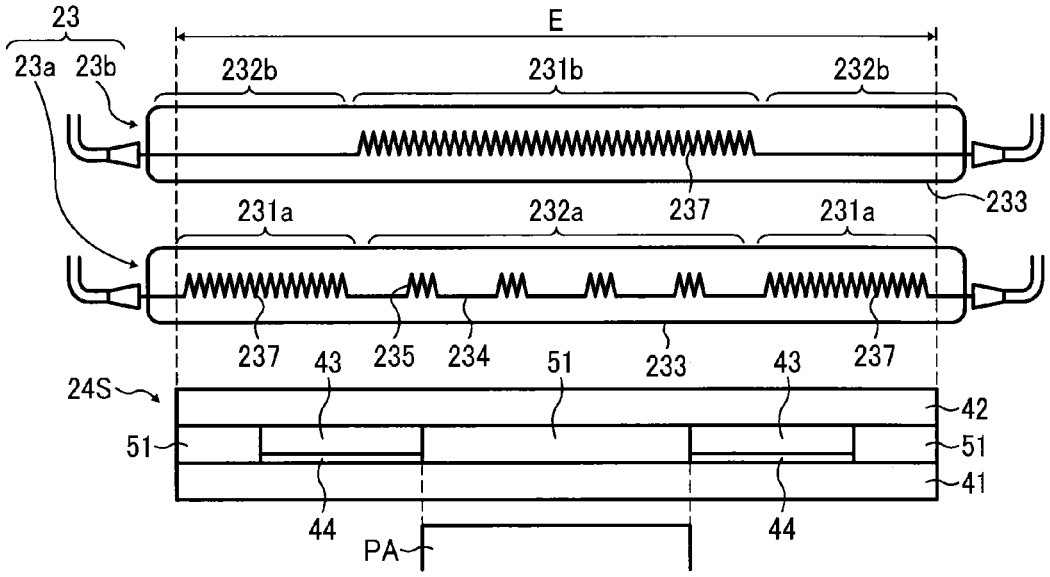
FIG. 14 is an exploded plan view of the halogen heater depicted in FIG. 8 and the nip formation pad depicted in FIG. 12.

FIG. 14 is an exploded plan view of the halogen heater 23 and the nip formation pad 24S. As illustrated in FIG. 14, the thermal equalizer 41 and the thermal absorber 42 span an entire heat generation span E in the longitudinal direction of the halogen heater 23 where the primary major heat generation portions 231*a* and the secondary major heat generation portion 231*b* span. The thermal absorber 43 is disposed opposite and spans from the gap between the primary major heat generation portion 231*a* of the lateral end heater 23*a* and the secondary major heat generation portion 231*b* of the center heater 23*b* in the longitudinal direction of the halogen heater 23. Accordingly, the halogen heater 23 suppresses sharp decrease in the amount of heat generated at the gap.

The sheet PA is not conveyed over the non-conveyance span of the fixing belt 21 that is disposed outboard in the axial direction of the fixing belt 21 from the conveyance span of the fixing belt 21 where the sheet PA is conveyed over the fixing belt 21. Accordingly, the sheet PA does not draw heat from the non-conveyance span of the fixing belt 21, causing temperature increase or overheating of the non-conveyance span of the fixing belt 21 disposed at each lateral end of the fixing belt 21 in the axial direction thereof. Such temperature increase or overheating is hereinafter referred to as lateral end temperature increase.

The non-conveyance span of the fixing belt 21 that suffers from the lateral end temperature increase is maximized when the minimum size sheet PA is conveyed over the fixing belt 21. The thermal equalizer 41 extends throughout an entire maximum non-conveyance span that is disposed outboard from the sheet PA and within the heat generation span E in the longitudinal direction of the halogen heater 23. Accordingly, the thermal equalizer 41 conducts heat in the longitudinal direction and the thickness direction of the nip formation pad 24S in the non-conveyance span of the fixing belt 21, suppressing the lateral end temperature increase.

A rim projecting from each lateral end of the thermal equalizer 41 in the sheet conveyance direction DP toward the thermal absorber 42 may extend throughout the entire span of the thermal equalizer 41 in the longitudinal direction thereof. The thermal equalizer 41 and the rim mounted thereon produce a U-like shape in cross-section that accommodates the base 51, the resin layer 44, and the thermal absorbers 43 and 42 that are layered on the thermal equalizer 41 precisely. Alternatively, a projection may project from an inner face, that is, an upper face in FIG. 13, of the thermal equalizer 41 to engage a through-hole produced in each of the base 51, the resin layer 44, the thermal absorber 43, and the like.

The thermal absorbers 42 and 43 are manufactured as separate components, respectively, not as a single component, to reduce manufacturing costs. If the thermal absorbers 42 and 43 are manufactured as a single component, it is necessary to produce a recess that accommodates the base 51 by cutting, increasing manufacturing costs.

A detailed description is now given of the thickness of each of the components of the nip formation pad 24S when a nip length of the fixing nip N in the sheet conveyance direction DP is about 10 mm.

The thermal equalizer 41 has a thickness in a range of from 0.2 mm to 0.6 mm. The thermal absorber 42 has a thickness in a range of from 1.8 mm to 6.0 mm. The thermal absorber 43 has a thickness in a range of from 1.0 mm to 2.0 mm. The resin layer 44 has a thickness in a range of from 0.5 mm to 1.5 mm. The base 51 has a thickness in a range of from 1.5 mm to 3.5 mm. However, the thickness of the respective components is not limited to the above.

A description is provided of variations of the nip formation pad 24S.

Figure 15A:
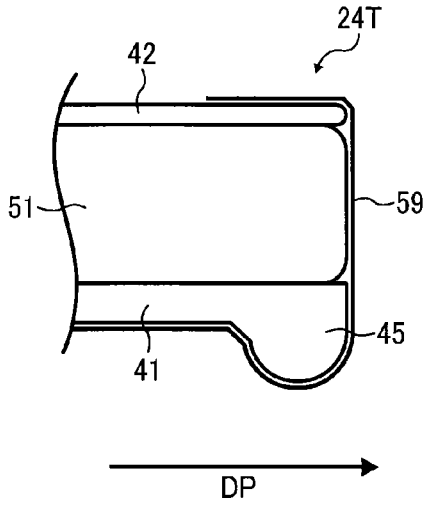
FIG. 15A is a schematic partial cross-sectional view of a nip formation pad as a first variation of the nip formation pad depicted in FIG. 12.
Figure 15B:
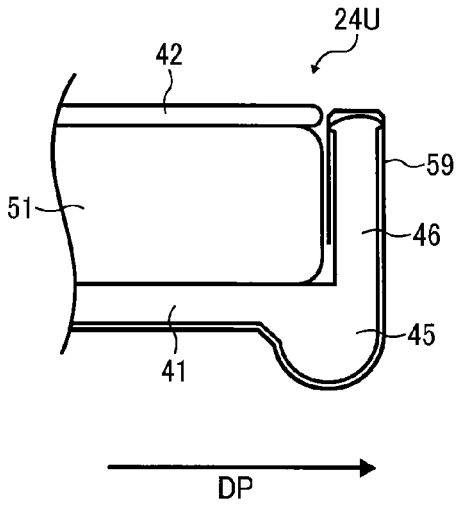
FIG. 15B is a schematic partial cross-sectional view of a nip formation pad as a second variation of the nip formation pad depicted in FIG. 12.

FIG. 15A is a schematic partial cross-sectional view of a nip formation pad 24T as a first variation of the nip formation pad 24S. FIG. 15B is a schematic partial cross-sectional view of a nip formation pad 24U as a second variation of the nip formation pad 24S. FIGS. 15A and 15B illustrate the nip formation pads 24T and 24U at the exit of the fixing nip N seen in the axial direction of the fixing belt 21.

As illustrated in FIG. 15A, a bulge 45 projects from the thermal equalizer 41 sandwiched between the base 51 and the fixing belt 21 toward the pressure roller 22 depicted in FIG. 2 at the exit of the fixing nip N, that is, the downstream end of the fixing nip N, in the sheet conveyance direction DP. The bulge 45 lifts the sheet P conveyed through the exit of the fixing nip N from the fixing belt 21, facilitating separation of the sheet P from the fixing belt 21. A low-friction sheet 59 is wound around the nip formation pad 24T to cover the thermal equalizer 41, the base 51, and the thermal absorber 42.

As illustrated in FIG. 15B, the bulge 45 projects from the thermal equalizer 41 toward the pressure roller 22 at the exit of the fixing nip N. A stopper 46 projects from the thermal equalizer 41 in a direction opposite a direction in which the bulge 45 projects from the thermal equalizer 41 along a downstream face of the base 51. The stopper 46 prevents the thermal equalizer 41 from moving in the circumferential direction of the fixing belt 21 even when the thermal equalizer 41 receives a predetermined force from the fixing belt 21 rotating in the rotation direction B1 and the sheet P conveyed in the sheet conveyance direction DP. The low-friction sheet 59 is wound around the nip formation pad 24U to cover the thermal equalizer 41. An end of the low-friction sheet 59 is nipped and secured between the base 51 and the stopper 46.

Figure 16:
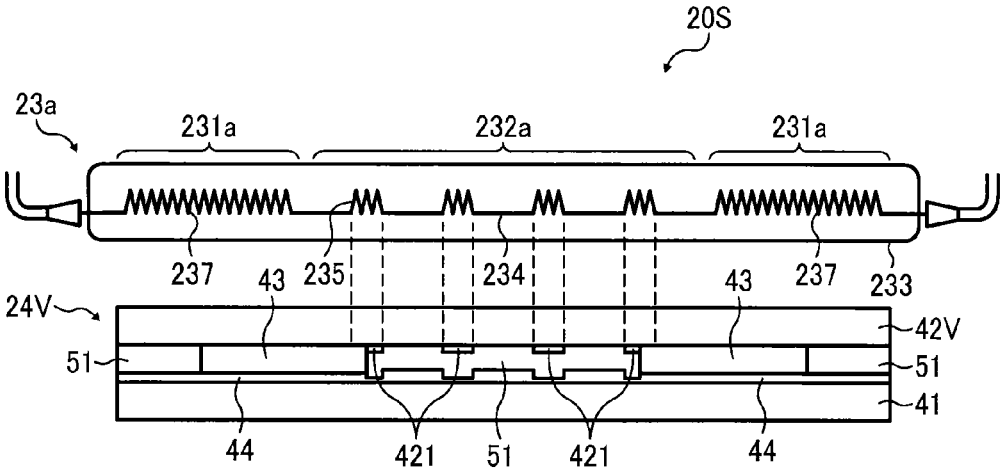
FIG. 16 is a partial exploded plan view of a fixing device according to a second exemplary embodiment of the present disclosure.

Referring to FIG. 16, a description is provided of a construction of a fixing device 20S according to a second exemplary embodiment that incorporates a nip formation pad 24V.

FIG. 16 is a partial exploded plan view of the fixing device 20S. As illustrated in FIG. 16, the nip formation pad 24V includes a thermal absorber 42V incorporating a plurality of projections 421 projecting toward the base 51. The projection 421 is disposed opposite the dense coil portion 235 and the supporter 236 in the primary minor heat generation portion 232*a* of the lateral end heater 23*a*. The projection 421 increases the thickness of the thermal absorber 42V. The projection 421 that increases the thickness of the thermal absorber 42V is disposed opposite the dense coil portion 235 and the supporter 236 that constitute an increased heat generation portion of the lateral end heater 23*a* in the primary minor heat generation portion 232*a* where the lateral end heater 23*a* generates an increased amount of heat, thus evening the temperature of the fixing belt 21 in the axial direction thereof effectively.

According to this exemplary embodiment, the resin layer 44 spans throughout the entire width of the nip formation pad 24V in a longitudinal direction thereof. In order to offset a projection amount of the projection 421, the thickness of the resin layer 44 is decreased or the resin layer 44 is partially cut out to produce a recess that corresponds to the projection 421.

Instead of increasing the thickness of the thermal absorber 42V, the thickness of the thermal equalizer 41 may increase at a part of the thermal equalizer 41 that is disposed opposite the dense coil portion 235 and the supporter 236 so as to increase the thermal capacity of the thermal equalizer 41 at that part, thus evening the temperature of the fixing belt 21 in the axial direction thereof. For example, the thermal equalizer 41 may be straight at the entry to the fixing nip N and tilted toward the exit of the fixing nip N to enhance conveyance of the sheet P and prevent creasing of the sheet P effectively.

Figure 17:
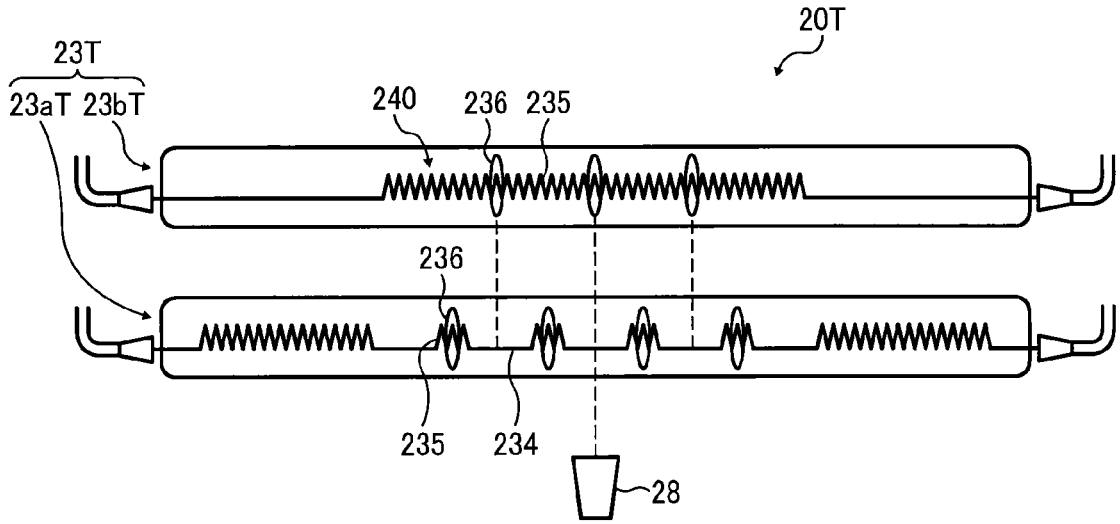
FIG. 17 is a partial plan view of a fixing device according to a third exemplary embodiment of the present disclosure.

Referring to FIG. 17, a description is provided of a construction of a fixing device 20T according to a third exemplary embodiment that incorporates a halogen heater 23T.

FIG. 17 is a plan view of the halogen heater 23T. As illustrated in FIG. 17, the halogen heater 23T includes a center heater 23*b*T and a lateral end heater 23*a*T. Like the lateral end heater 23*a*T, the center heater 23*b*T is a non-partial heater. Each of the lateral end heater 23*a*T and the center heater 23*b*T includes a plurality of supporters 236 aligned in a longitudinal direction of the halogen heater 23T with a predetermined interval between the adjacent supporters 236. The supporter 236 of the lateral end heater 23*a*T and the supporter 236 of the center heater 23*b*T are arranged alternately in the longitudinal direction of the halogen heater 23T.

For example, the supporter 236 of the center heater 23*b*T is disposed opposite the filament wire portion 234 of the lateral end heater 23*a*T. Conversely, the dense coil portion 235 and the supporter 236 of the lateral end heater 23*a*T are disposed opposite a decreased heat generation portion 240 of the center heater 23*b*T where the supporter 236 is not disposed. An amount of heat generated by the decreased heat generation portion 240 is relatively smaller than that generated by a portion of the center heater 23*b*T where the supporter 236 is disposed. Accordingly, a wave crest of a temperature distribution of one of the center heater 23*b*T and the lateral end heater 23*a*T corresponds to a wave trough of the temperature distribution of another one of the center heater 23*b*T and the lateral end heater 23*a*T, thus evening the amount of heat conducted from the halogen heater 23T to the fixing belt 21 in the axial direction thereof or evening a temperature distribution of the fixing belt 21 in the axial direction thereof. For example, the number of the dense coil portions 235 and the supporters 236 of one of the center heater 23*b*T and the lateral end heater 23*a*T is an odd number. Conversely, the number of the dense coil portions 235 and the supporters 236 of another one of the center heater 23*b*T and the lateral end heater 23*a*T is an even number. Accordingly, the wave crest of the temperature distribution of one of the center heater 23*b*T and the lateral end heater 23*a*T corresponds to the wave trough of the temperature distribution of another one of the center heater 23*b*T and the lateral end heater 23*a*T, alternately.

Although the above describes a constructional relation between the center heater 23*b*T and the lateral end heater 23*a*T at a center span of the center heater 23*b*T and the lateral end heater 23*a*T in the longitudinal direction of the halogen heater 23T with reference to FIG. 17, the center heater 23*b*T and the lateral end heater 23*a*T have a similar constructional relation at a lateral end span of the center heater 23*b*T and the lateral end heater 23*a*T in the longitudinal direction of the halogen heater 23T. Alternatively, the supporter 236 of the center heater 23*b*T and the supporter 236 of the lateral end heater 23*a*T may be arranged alternately in the longitudinal direction of the halogen heater 23T at one of the center span and the lateral end span of the center heater 23*b*T and the lateral end heater 23*a*T in the longitudinal direction of the halogen heater 23T.

The temperature sensor 28 is disposed opposite the intermediate position between the adjacent supporters 236, that is, the intermediate position between the adjacent dense coil portions 235, in the primary minor heat generation portion 232*a* of the lateral end heater 23*a*T in the longitudinal direction of the halogen heater 23T. That is, the temperature sensor 28 is disposed opposite a center or a vicinity of the center of the lateral end heater 23*a*T, that is, the center or the vicinity of the center of the fixing belt 21 in the axial direction thereof. In a center span of the halogen heater 23T in the longitudinal direction thereof, the temperature ripple T1 of the center heater 23*b*T is smaller than the temperature ripple T1 of the lateral end heater 23*a*T. Accordingly, the temperature sensor 28 is disposed opposite substantially the center of the fixing belt 21 in the axial direction thereof where the temperature of the outer circumferential surface of the fixing belt 21 is susceptible to temperature decrease most.

Since the temperature sensor 28 is disposed opposite substantially the center of the lateral end heater 23*a*T in the longitudinal direction of the halogen heater 23T, the number of the dense coil portions 235 and the supporters 236 in the primary minor heat generation portion 232*a* of the lateral end heater 23*a*T is the even number.

FIG. 17 illustrates the dense coil portions 235 disposed in the center span of each of the center heater 23*b*T and the lateral end heater 23*a*T in the longitudinal direction of the halogen heater 23T. Similarly, the dense coil portions 235 are alternately disposed in each lateral end span of the lateral end heater 23*a*T in the longitudinal direction of the halogen heater 23T.

Figure 18:
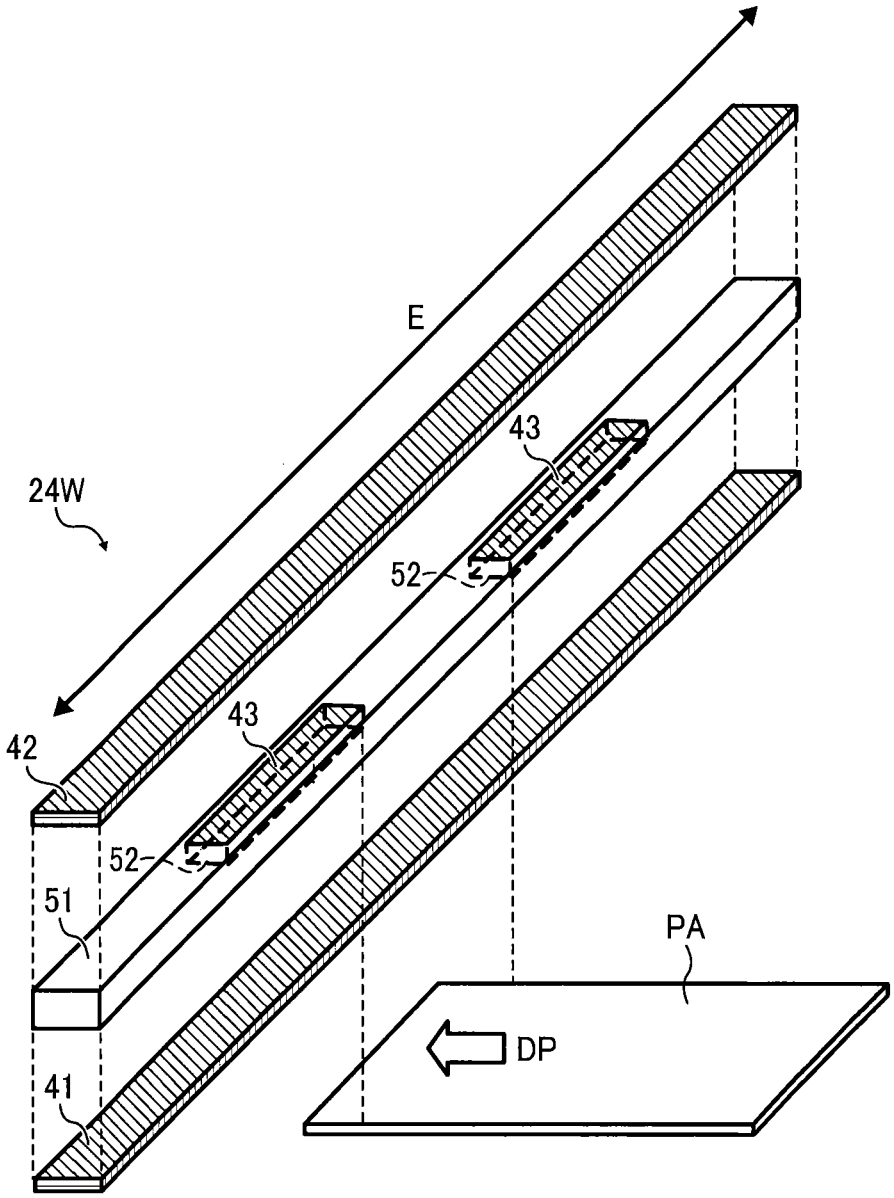
FIG. 18 is a schematic exploded perspective view of a nip formation pad incorporated in a fixing device according to a fourth exemplary embodiment of the present disclosure.

Referring to FIG. 18, a description is provided of a construction of a fixing device according to a fourth exemplary embodiment.

FIG. 18 is a schematic exploded perspective view of a nip formation pad 24W incorporated in the fixing device according to the fourth exemplary embodiment. As illustrated in FIG. 18, the thermal absorber 43 is sandwiched between the thermal equalizer 41 and the thermal absorber 42 at two positions aligned in a longitudinal direction of the nip formation pad 24W like in the nip formation pad 24S depicted in FIG. 13. The thermal absorber 43 is embedded in a recess 52 provided in the base 51. Hence, the nip formation pad 24W includes the base 51, the thermal equalizer 41, and the thermal absorbers 42 and 43. The recess 52 does not penetrate through the base 51. A thickness of the recess 52 is smaller than a thickness of a portion of the base 51 that is not provided with the recess 52. In order to adjust an amount of heat conducted from the thermal equalizer 41 to the thermal absorber 42 through the thermal absorber 43, the thickness of the recess 52 is adjusted properly. A length of the recess 52 in the sheet conveyance direction DP is also adjusted properly based on an amount of heat to be absorbed by the thermal absorber 43. For example, the length of the recess 52 in the sheet conveyance direction DP is increased to allow the thermal absorber 43 to absorb an increased amount of heat. Conversely, the length of the recess 52 in the sheet conveyance direction DP is decreased to allow the thermal absorber 43 to absorb a decreased amount of heat. The thermal absorber 43 is leveled with the base 51 in a thickness direction of the nip formation pad 24W perpendicular to the longitudinal direction of the nip formation pad 24W so that the thermal absorber 43 and the base 51 share an identical plane. Alternatively, the recess 52 may penetrate through the base 51 so that the thickness of the recess 52 is equivalent to the thickness of the portion of the base 51 that is not provided with the recess 52.

Figure 19:
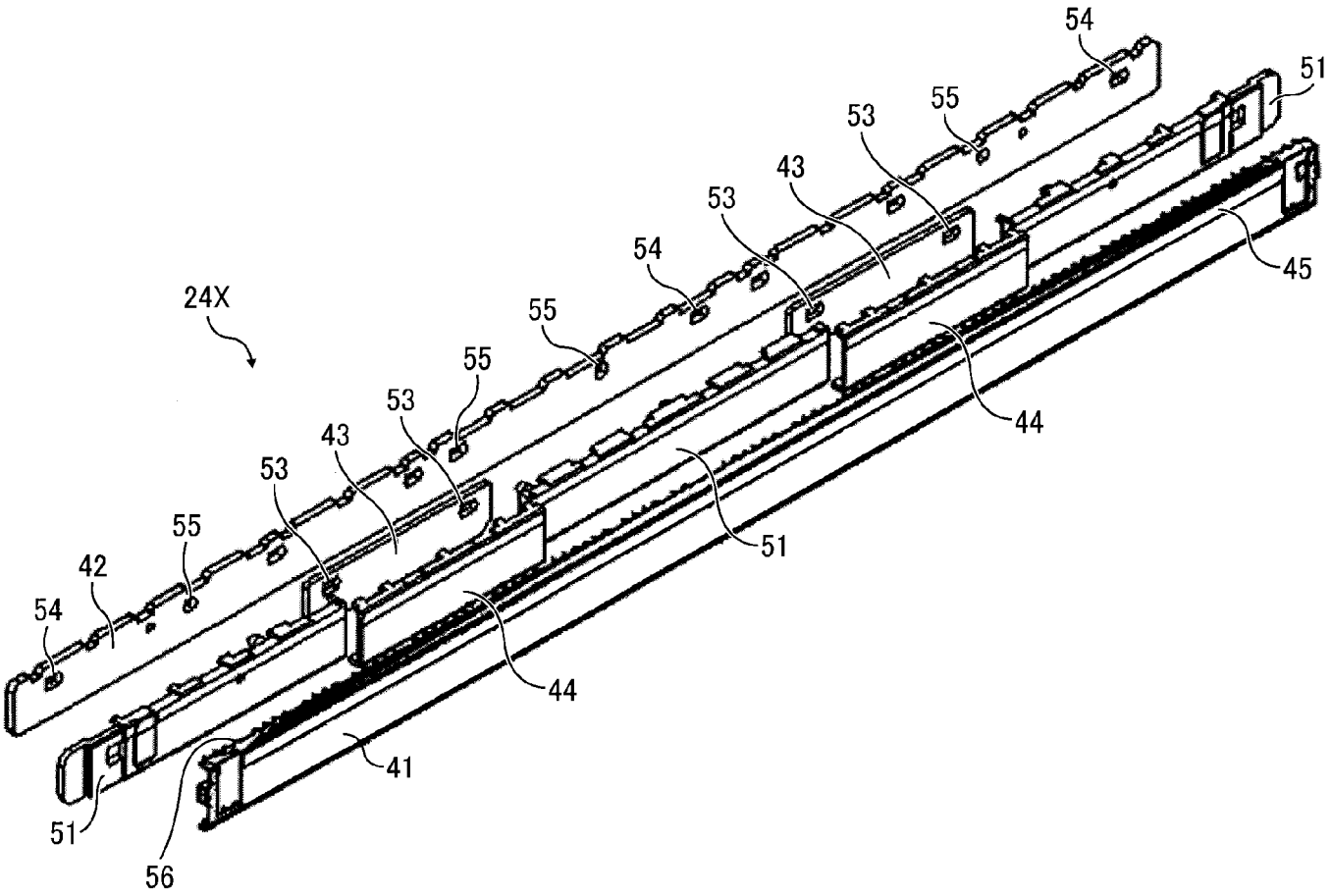
FIG. 19 is a schematic exploded perspective view of a nip formation pad incorporated in a fixing device according to a fifth exemplary embodiment of the present disclosure.
Figure 20:
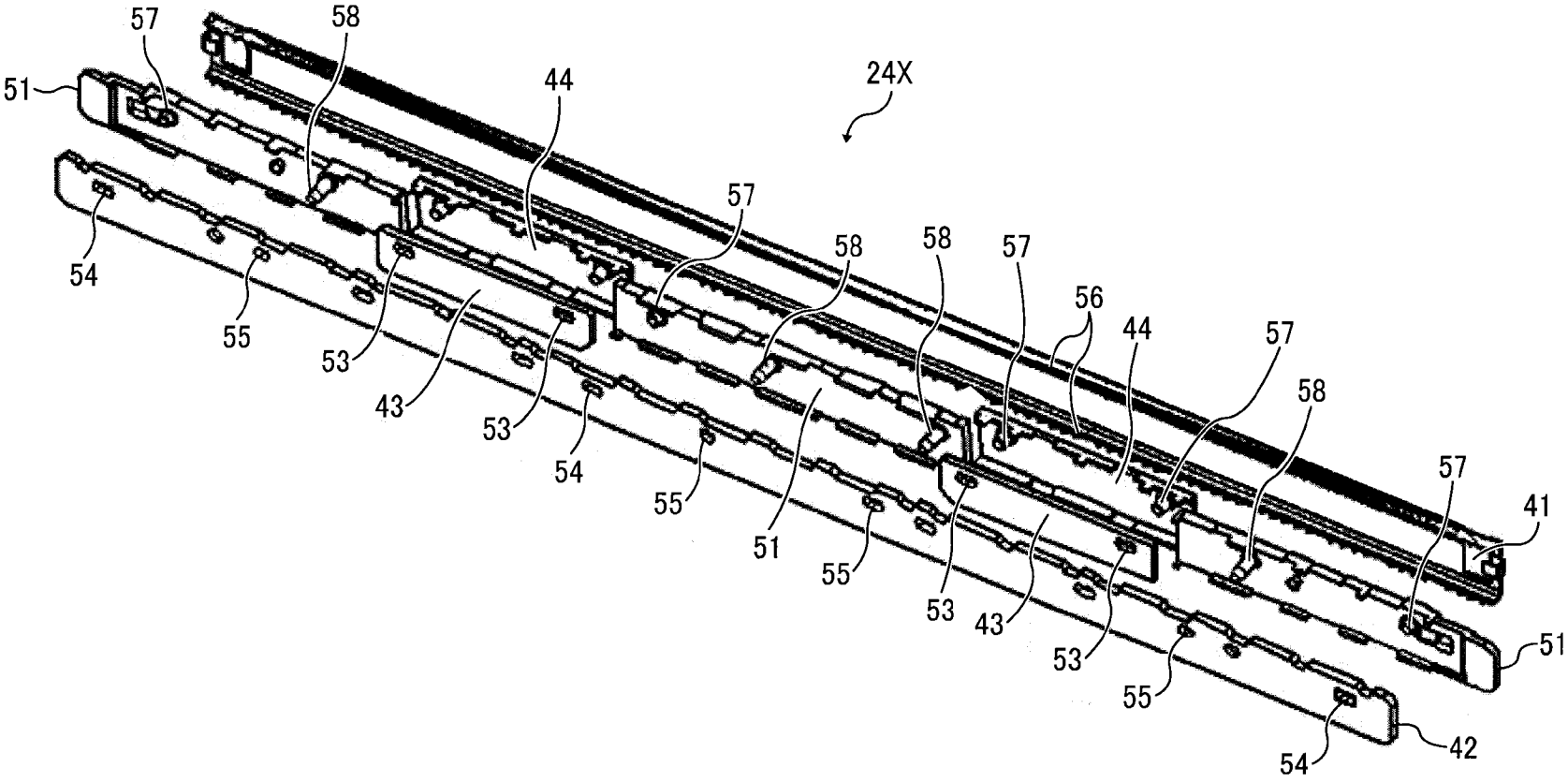
FIG. 20 is a schematic exploded perspective view of the nip formation pad depicted in FIG. 19 seen from an opposite direction.

Referring to FIGS. 19 and 20, a description is provided of a construction of a fixing device according to a fifth exemplary embodiment.

FIG. 19 is a schematic exploded perspective view of a nip formation pad 24X incorporated in the fixing device according to the fifth exemplary embodiment seen from the fixing nip N. FIG. 20 is a schematic exploded perspective view of the nip formation pad 24X seen from the stay 25 depicted in FIG. 2. The following describes a construction of the nip formation pad 24X that is different from the construction of the nip formation pads 24, 24S, 24T, 24U, 24V, and 24W described above.

An upstream end and a downstream end of the thermal equalizer 41 in the sheet conveyance direction DP are folded toward the stay 25 into rims, respectively, to contour the thermal equalizer 41 into a U-shape in cross-section. Accordingly, the thermal equalizer 41 with the rims accommodates the base 51, the resin layer 44, and the thermal absorbers 43 and 42 that are layered on the thermal equalizer 41 precisely. The upstream end and the downstream end of the thermal equalizer 41 in the sheet conveyance direction DP mount teeth 56. The teeth 56 are not contiguously produced throughout the entire span of the thermal equalizer 41 in the longitudinal direction thereof. For example, planar portions are aligned in the longitudinal direction of the thermal equalizer 41 with a predetermined interval between the adjacent planar portions. The teeth 56 precisely catch or engage the low-friction sheet 59 depicted in FIGS. 15A and 15B that is wound around an outer circumferential surface of the nip formation pad 24X when the nip formation pad 24X is assembled, preventing the low-friction sheet 59 from being displaced in accordance with rotation of the fixing belt 21. A jig used to attach the low-friction sheet 59 to the nip formation pad 24X comes into contact with the planar portion of the thermal equalizer 41.

As illustrated in FIG. 20, the teeth 56 are mounted on the rim of the thermal equalizer 41 at each lateral end thereof in the sheet conveyance direction DP. Alternatively, the teeth 56 may be mounted on one lateral end of the thermal equalizer 41 disposed opposite the entry to the fixing nip N in the sheet conveyance direction DP, that is, a lower end of the thermal equalizer 41 in FIG. 20. Since the fixing belt 21 moves from the entry to the exit of the fixing nip N, if the teeth 56 situated at the entry to the fixing nip N catch the low-friction sheet 59 precisely, it may not be necessary to produce the teeth 56 at the exit of the fixing nip N.

As illustrated in FIG. 19, a plurality of through-holes 54 and a plurality of through-holes 55 penetrate through the thermal absorber 42. A plurality of through-holes 53 penetrates through the thermal absorber 43. As illustrated in FIG. 20, a plurality of projections 58 projecting from an inner face of the base 51 toward the thermal absorber 42 is inserted into the plurality of through-holes 55, respectively. A plurality of projections 57 projecting from an inner face of the base 51 toward the thermal absorber 42 is inserted into the plurality of through-holes 54, respectively. A plurality of projections 57 projecting from an inner face of the resin layer 44 toward the thermal absorbers 43 and 42 is inserted into the plurality of through-holes 53, respectively. The projection 57 projecting from the resin layer 44 is inserted into the through-hole 53 penetrating through the thermal absorber 43 to hold the thermal absorber 43. The projection 57 projecting from the base 51 is inserted into the through-hole 54 penetrating through the thermal absorber 42 to hold the thermal absorber 42. The projection 58 projecting from the base 51 is inserted into the through-hole 55 penetrating through the thermal absorber 42 to hold the thermal absorber 42. The projection 58 is longer than the projection 57 in a projection direction perpendicular to a longitudinal direction of the nip formation pad 24X. Accordingly, the projection 58 penetrating through the through-hole 55 penetrating through the thermal absorber 42 engages an engagement hole of the stay 25, thus mounting or securing the entire nip formation pad 24X on the stay 25.

As illustrated in FIG. 19, the bulge 45 projects from the thermal equalizer 41 toward the pressure roller 22 at the downstream end of the thermal equalizer 41 disposed opposite the exit of the fixing nip N. For example, the thermal equalizer 41 is made of a single copper plate that is planar from the entry to the exit of the fixing nip N, that is, vertically upward in FIG. 19, and curved at the exit of the fixing nip N to project toward the pressure roller 22 depicted in FIG. 2, producing the bulge 45.

A description is provided of variations of the fixing devices according to the exemplary embodiments described above.

The primary major heat generation portion 231*a* and the secondary major heat generation portion 231*b* are hereinafter referred to as a main heat generation portion. The primary minor heat generation portion 232*a* and the secondary minor heat generation portion 232*b* are hereinafter referred to as a sub heat generation portion or a non-main heat generation portion. The major heat generator is hereinafter referred to as a heat generator. The minor heat generator is hereinafter referred to as a sub heat generator or a non-heat generator.

Figure 21:
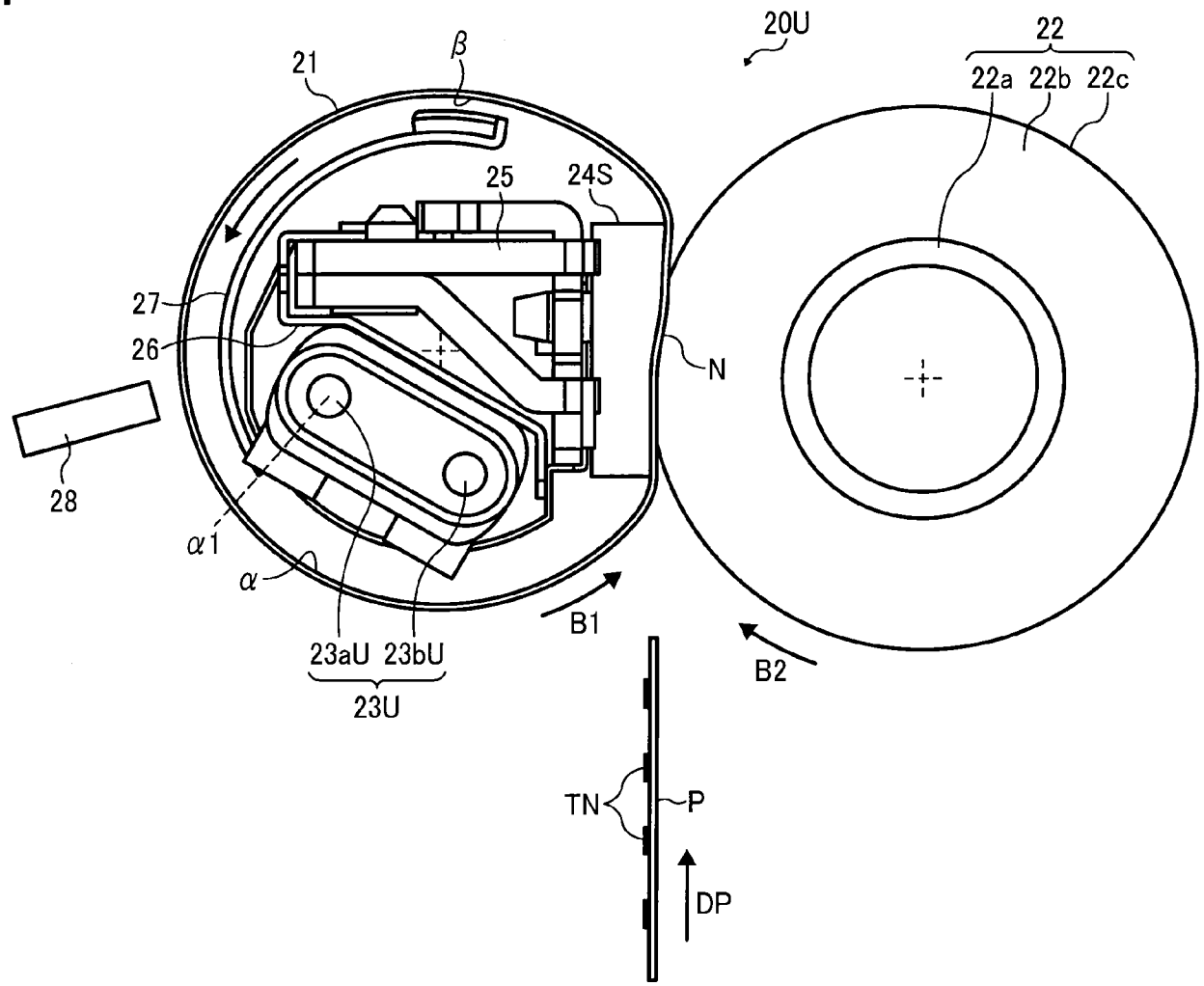
FIG. 21 is a schematic vertical cross-sectional view of a fixing device according to a sixth exemplary embodiment of the present disclosure.
Figure 22:
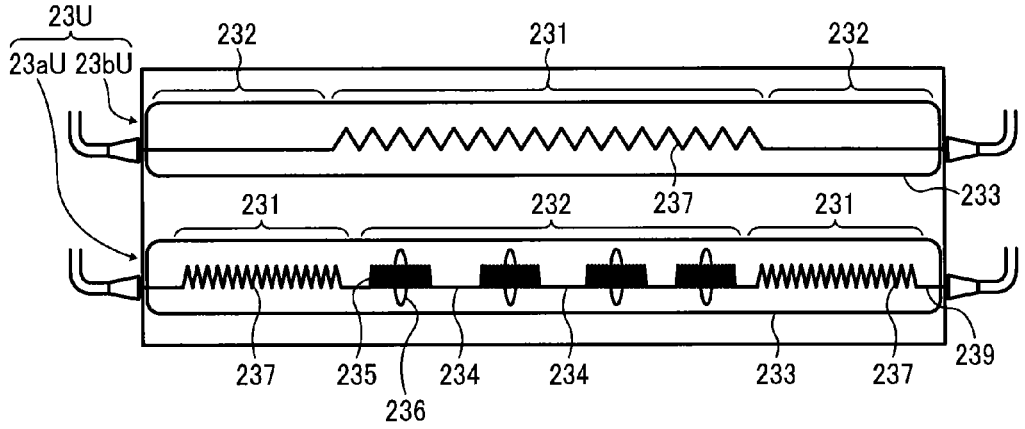
FIG. 22 is a plan view of a halogen heater incorporated in the fixing device depicted in FIG. 21.

Referring to FIGS. 21 and 22, a description is provided of a construction of a fixing device 20U according to a sixth exemplary embodiment.

FIG. 21 is a schematic vertical cross-sectional view of the fixing device 20U. FIG. 22 is a plan view of a halogen heater 23U incorporated in the fixing device 20U. The following describes a construction of the fixing device 20U that is different from the construction of the fixing device 20 described above. As illustrated in FIG. 22, the halogen heater 23U includes a lateral end heater 23*a*U serving as a primary heater and a center heater 23*b*U serving as a secondary heater.

The lateral end heater 23*a*U includes the single filament wire 239 made of tungsten, for example. The lateral end heater 23*a*U is a filament lamp including the glass tube 233 serving as a luminous tube and the single filament wire 239 disposed inside the glass tube 233. For example, the glass tube 233 is made of quartz glass.

The lateral end heater 23*a*U has a main heat generation portion 231 disposed at each lateral end span of the lateral end heater 23*a*U in a longitudinal direction of the halogen heater 23U parallel to the axial direction of the fixing belt 21. The main heat generation portion 231 includes the dense coil portion 237 serving as a heat generator or a light emitter where the filament wire 239 is coiled densely.

The lateral end heater 23*a*U has a sub heat generation portion 232 disposed at a center span of the lateral end heater 23*a*U in the longitudinal direction of the halogen heater 23U. The sub heat generation portion 232 includes the filament wire portion 234, the dense coil portion 235, and the supporter 236. The filament wire portion 234 serves as a sub heat generator, a non-heat generator, or a non-light emitter where the filament wire 239 is straight and less dense than the filament wire 239 of the dense coil portion 235. The dense coil portion 235 serves as a heat generator sandwiched between the adjacent filament wire portions 234 in the longitudinal direction of the halogen heater 23U. A plurality of dense coil portions 235 is aligned with a predetermined interval between the adjacent dense coil portions 235 in the longitudinal direction of the halogen heater 23U. The supporter 236 serving as a holder is mounted on the dense coil portion 235 serving as a held portion. Alternatively, the filament wire portion 234 may be a non-dense coil portion where the filament wire 239 is coiled less densely than the filament wire 239 of the dense coil portion 235. For example, the filament wire portion 234 may be a rough helix.

The center heater 23$b$U has the main heat generation portion 231 disposed at a center span of the center heater 23$b$U in the longitudinal direction of the halogen heater 23U. The center heater 23$b$U has the sub heat generation portion 232 disposed at each lateral end span of the center heater 23$b$U in the longitudinal direction of the halogen heater 23U. The center heater 23$b$U is a partial heater described below that does not incorporate the dense coil portion 235 and the supporter 236.

The supporter 236 of the lateral end heater 23$a$U is constructed of the single filament wire 239 made of tungsten, for example. The single filament wire 239 constituting the supporter 236 may be hereinafter referred to as a supporter wire. The supporter 236 is a ring that contacts an inner circumferential surface of the glass tube 233. The dense coil portion 235 is constructed of the filament wire 239 coiled densely. The supporter 236 is mounted on the dense coil portion 235. Thus, the filament wire 239 disposed inside the lateral end heater 23$a$U is supported by the glass tube 233 indirectly. Thus, the filament wire 239 retains a desired shape inside the glass tube 233.

FIG. 22 omits the supporter 236 disposed in the main heat generation portion 231 of the lateral end heater 23$a$U. Like the sub heat generation portion 232, the main heat generation portion 231 has the plurality of supporters 236 aligned with a uniform interval between the adjacent supporters 236 in the longitudinal direction of the halogen heater 23U. Thus, the supporters 236 retain the desired shape of the filament wire 239 in the main heat generation portion 231.

As described above, the main heat generation portion 231 of the lateral end heater 23$a$U that has the dense coil portion 237 where the filament wire 239 is coiled densely heats the fixing belt 21 mainly. However, the filament wire 239 and the like of the dense coil portion 235 disposed in the sub heat generation portion 232 also generate heat, heating the fixing belt 21 substantially.

Since the sub heat generation portion 232 includes the filament wire portion 234 and the dense coil portion 235 that has the filament wire 239 coiled densely and is supported by the supporter 236, the density of the filament wire 239 is uneven in the longitudinal direction of the halogen heater 23U. Accordingly, an amount of heat generated in the sub heat generation portion 232 varies in the longitudinal direction of the halogen heater 23U, heating the fixing belt 21 unevenly in the axial direction thereof.

A detailed description is provided of variation in the amount of heat generated in the sub heat generation portion 232 in the longitudinal direction of the halogen heater 23U, which results in variation in the amount of heat conducted to the fixing belt 21 in the axial direction thereof.

Figure 23A:
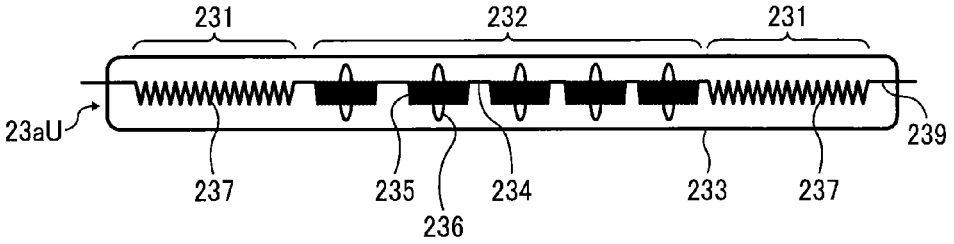
FIG. 23A is a plan view of a lateral end heater incorporated in the halogen heater depicted in FIG. 22 incorporating an increased number of dense coil portions.
Figure 23B:
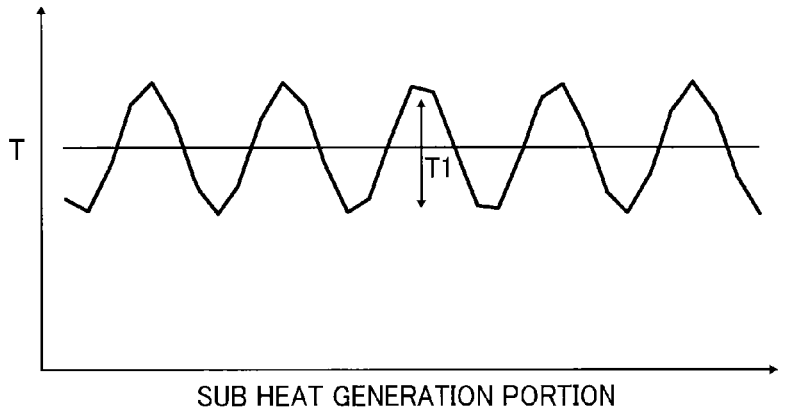
FIG. 23B is a graph illustrating a relation between a position in a sub heat generation portion of the lateral end heater depicted in FIG. 23A and a temperature of a fixing belt.

FIG. 23A is a plan view of the lateral end heater 23$a$U. FIG. 23B is a graph illustrating a relation between the position in the sub heat generation portion 232 of the lateral end heater 23$a$U in the longitudinal direction of the halogen heater 23U and the temperature T of the fixing belt 21. That is, FIG. 23B illustrates a temperature distribution of the fixing belt 21 in the axial direction thereof. In FIG. 23B, an X-axis represents the position of the fixing belt 21 in the sub heat generation portion 232 in the axial direction of the fixing belt 21. A Y-axis represents the temperature T of the fixing belt 21.

As illustrated in FIGS. 23A and 23B, in the sub heat generation portion 232, the dense coil portion 235 is constructed of the filament wire 239 coiled densely and supported by the supporter 236. Accordingly, the temperature T of a portion of the fixing belt 21 that is disposed opposite the dense coil portion 235 is higher than the temperature T of a portion of the fixing belt 21 that is disposed opposite the filament wire portion 234. Consequently, the sub heat generation portion 232 generates the temperature difference T1 (hereinafter also referred to as the temperature ripple T1) in the temperature T of the fixing belt 21, that is, the amount of heat conducted to the fixing belt 21. As a result, the surface temperature of the fixing belt 21 creates a temperature distribution illustrated by a wave in FIG. 23B.

Figure 24A:
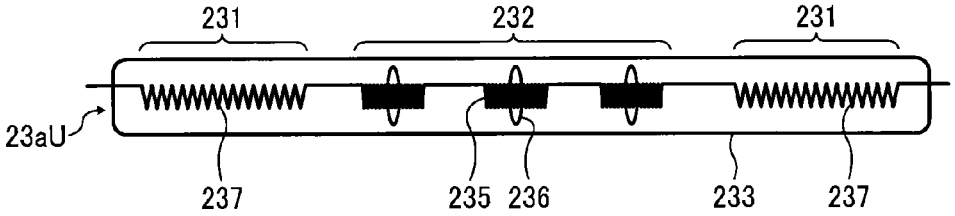
FIG. 24A is a plan view of a lateral end heater incorporated in the halogen heater depicted in FIG. 22 incorporating a decreased number of dense coil portions.
Figure 24B:
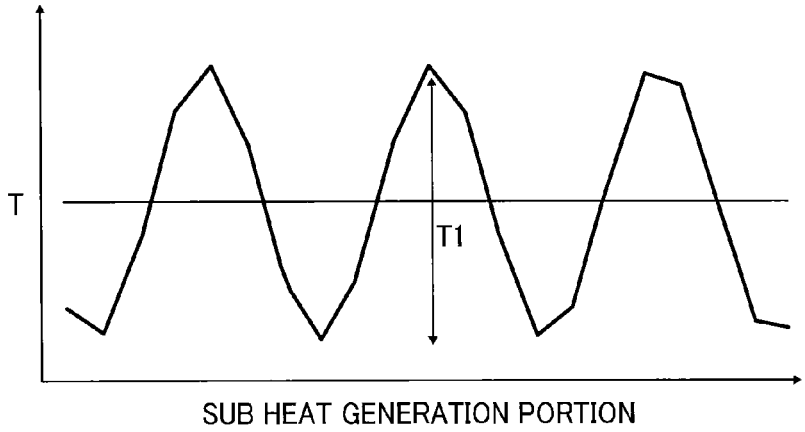
FIG. 24B is a graph illustrating a relation between the position in the sub heat generation portion of the lateral end heater depicted in FIG. 24A and the temperature of the fixing belt.

FIG. 24A is a plan view of the lateral end heater 23$a$U incorporating a decreased number of the dense coil portions 235. FIG. 24B is a graph illustrating a relation between the position in the sub heat generation portion 232 and the temperature T of the fixing belt 21. As illustrated in FIG. 24A, the number of the supporters 236 and the dense coil portions 235 is reduced in the sub heat generation portion 232 to decrease the number of the dead coils situated in the sub heat generation portion 232. Accordingly, redundant heat generation from the sub heat generation portion 232 is reduced, attaining energy saving inside the fixing device 20U.

On the other hand, as illustrated in FIG. 24B, as the number of the dead coils decreases, an interval between the adjacent dead coils (e.g., an interval between the adjacent supporters 236 or an interval between the adjacent dense coil portions 235) increases and temperature decrease of the filament wire portion 234 progresses, thus increasing the temperature difference between the temperature of the dense coil portion 235 and the filament wire portion 234. Accordingly, the temperature ripple T1 in FIG. 24B is greater than the temperature ripple T1 in FIG. 23B.

As illustrated in FIG. 21, the temperature sensor 28 is disposed downstream from the exit (e.g., the downstream end) of the fixing nip N and in proximity to and upstream from the heating position $\alpha$1 in the rotation direction B1 of the fixing belt 21. The temperature sensor 28 detects the temperature of the outer circumferential surface of the fixing belt 21 before the halogen heater 23U heats the fixing belt 21. The controller determines an amount of heat to be generated by the halogen heater 23U to heat the fixing belt 21 based on the detected temperature of the fixing belt 21.

However, as described above, as the temperature ripple T1 increases, the temperature of the fixing belt 21 detected by the temperature sensor 28 may vary substantially depending on the position where the temperature sensor 28 detects the temperature of the fixing belt 21. Accordingly, the controller may not determine the amount of heat to be generated by the halogen heater 23U precisely. For example, if the temperature sensor 28 detects the temperature of the fixing belt 21 at a position where the outer circumferential surface of the fixing belt 21 has an increased temperature, the controller may determine a decreased amount of heat to be generated by the halogen heater 23U that is lower than an appropriate amount of heat. Accordingly, the halogen heater 23U may not heat the fixing belt 21 sufficiently, causing cold offset. If the controller increases the amount of heat to be generated by the halogen heater 23U to prevent cold offset, the halogen heater 23U may heat the fixing belt 21 redundantly, wasting energy and degrading energy saving of the fixing device 20U.

Figure 25:
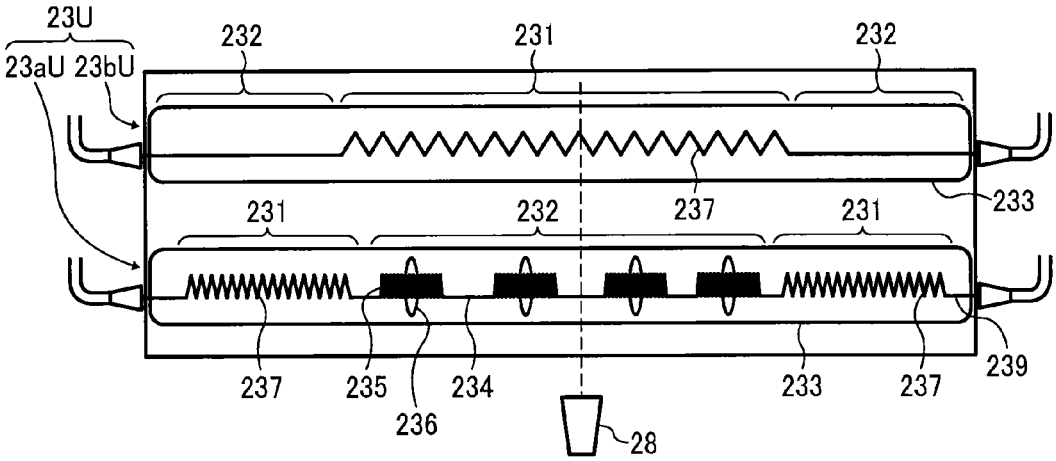
FIG. 25 is a plan view of the halogen heater depicted in FIG. 22.

FIG. 25 is a plan view of the halogen heater 23U. As illustrated in FIG. 25, in order to address this circumstance, the temperature sensor 28 is disposed opposite the intermediate position between the adjacent supporters 236, that is, the intermediate position between the adjacent dense coil portions 235, in the sub heat generation portion 232 of the lateral end heater 23$a$U in the longitudinal direction of the halogen heater 23U. That is, the temperature sensor 28 is disposed opposite a center or a vicinity of the center of the lateral end heater 23*a*U, that is, the center or the vicinity of the center of the fixing belt 21 in the axial direction thereof.

The amount of heat conducted to the fixing belt 21 decreases at the intermediate position between the adjacent supporters 236 in the longitudinal direction of the halogen heater 23U as illustrated with a wave trough of a temperature curve in FIG. 23B. According to this exemplary embodiment, while the sheet P is conveyed over the fixing belt 21, the sheet P is centered on the fixing belt 21 in the axial direction thereof. Hence, the center of the sheet P in the width direction thereof parallel to the axial direction of the fixing belt 21 is disposed opposite the center of the lateral end heater 23*a*U in the longitudinal direction of the halogen heater 23U. As the sheet P is conveyed over the fixing belt 21, heat is conducted from the outer circumferential surface of the fixing belt 21 to the sheet P, decreasing the temperature of the outer circumferential surface of the fixing belt 21 in the conveyance span of the fixing belt 21 where the sheet P is conveyed.

To address this circumstance, the temperature sensor 28 is disposed opposite the center span of the fixing belt 21 in the axial direction thereof where the temperature of the outer circumferential surface of the fixing belt 21 is susceptible to temperature decrease most so as to detect the temperature of the fixing belt 21. The temperature ripple T1 that may appear in the axial direction of the fixing belt 21 is measured in advance. The controller determines the amount of heat to be generated by the halogen heater 23U based on the measured temperature ripple T1 so that the fixing belt 21 attains a desired fixing temperature high enough to fix the toner image TN on the sheet P even in the center span of the fixing belt 21 in the axial direction thereof where the temperature sensor 28 detects the temperature of the fixing belt 21 and that the fixing belt 21 does not overheat to a temperature higher than the desired fixing temperature even at a position on the fixing belt 21 where the fixing belt 21 is heated most to a highest temperature.

As described above, the controller determines the amount of heat to be generated by the halogen heater 23U based on a lowest temperature of the fixing belt 21. Accordingly, the fixing belt 21 attains the desired fixing temperature even at the position on the fixing belt 21 where the fixing belt 21 is susceptible to the lowest temperature, preventing cold offset. Additionally, the halogen heater 23U does not heat the fixing belt 21 redundantly to prevent cold offset, achieving energy saving of the fixing device 20U.

As illustrated in FIG. 21, the halogen heater 23U heats the fixing belt 21 at the heating position α1 on the surface of the fixing belt 21 where the heat shield 27 or the like does not shield the fixing belt 21 from the halogen heater 23U. The halogen heater 23U is spaced apart from the fixing belt 21 with a smallest interval at the heating position α1.

The temperature sensor 28 situated as described above detects the temperature of the outer circumferential surface of the fixing belt 21 after the sheet P conveyed through the fixing nip N draws heat from the fixing belt 21 and immediately before the halogen heater 23U heats the fixing belt 21. Accordingly, the controller determines the amount of heat to be generated by the halogen heater 23U to heat the fixing belt 21 precisely.

In order to determine the amount of heat to be generated by the halogen heater 23U precisely, it is preferable to locate the temperature sensor 28 at the position illustrated in FIG. 21 where the temperature sensor 28 is disposed upstream from the halogen heater 23U in the rotation direction B1 of the fixing belt 21 so that the temperature sensor 28 detects the temperature of the fixing belt 21 immediately before the halogen heater 23U heats the fixing belt 21. Alternatively, the temperature sensor 28 may be disposed at other positions that are downstream from the fixing nip N and upstream from the heating position α1 in the rotation direction B1 of the fixing belt 21. However, according to this exemplary embodiment, the temperature sensor 28 is disposed in proximity to the heating position α1 and the halogen heater 23U so that the temperature sensor 28 also serves as a safety device of the fixing device 20U. For example, even if the amount of heat generated by the halogen heater 23U increases excessively due to some failure, the temperature sensor 28 detects the failure and allows the controller to perform emergency measures such as powering off of the fixing device 20U.

According to this exemplary embodiment, the temperature sensor 28 is disposed opposite substantially the center of the lateral end heater 23*a*U in the longitudinal direction of the halogen heater 23U as illustrated in FIG. 25. Alternatively, the temperature sensor 28 may be situated at other positions as long as the temperature sensor 28 is disposed opposite substantially the center of the fixing belt 21 in the axial direction thereof where the sheet P is conveyed over the fixing belt 21. It is preferable that the temperature sensor 28 is disposed opposite substantially the center of the fixing belt 21 in the axial direction thereof where the sheet P is conveyed. Alternatively, the temperature sensor 28 may be disposed opposite the intermediate position between the adjacent supporters 236 in the longitudinal direction of the halogen heater 23U, thus attaining the advantages described above. For example, if the fixing device 20U is configured to convey the sheet P such that one lateral edge of the sheet P in the width direction thereof is defined along one lateral end of the fixing belt 21 in the axial direction thereof, the center of the sheet P in the width direction thereof varies depending on the size of the sheet P. Accordingly, the position of the temperature sensor 28 is adjusted properly. For example, the temperature sensor 28 is disposed opposite substantially an axial span of the fixing belt 21 in the axial direction thereof that corresponds to substantially the center of the sheet P of any one of a plurality of sizes of the sheets P available in the fixing device 20U.

The center heater 23*b*U has the main heat generation portion 231 disposed at the center span of the center heater 23*b*U in the longitudinal direction of the halogen heater 23U. The center heater 23*b*U is a partial heater including a copper wire, instead of the supporter 236, to retain a desired shape of the filament wire 239. The copper wire spans throughout the entire width of the center heater 23*b*U in the longitudinal direction of the halogen heater 23U. The helical filament wire 239 is wound around the copper wire to retain the desired shape of the filament wire 239.

Since the number of the dense coil portions 235 of the partial heater is smaller than the number of the dense coil portions 235 of the non-partial heater, the partial heater barely generates heat in the sub heat generation portion 232. Accordingly, the sub heat generation portion 232 barely generates the temperature ripple T1. On the other hand, since the sub heat generation portion 232 barely generates heat, sharp temperature decrease may occur at a boundary between the sub heat generation portion 232 and the main heat generation portion 231. Accordingly, compared to a configuration in which the non-partial heater is used as the lateral end heater 23*a*U and the center heater 23*b*U, the halogen heater 23U may not heat the fixing belt 21 sufficiently at the boundary between the sub heat generation portion 232 and the main heat generation portion 231 of each of the center heater 23$b$U and the lateral end heater 23$a$U. Consequently, the halogen heater 23U may not heat the sheet P sufficiently to fix the toner image TN on the sheet P. For example, if a gap is created between the main heat generation portion 231 of the lateral end heater 23$a$U and the main heat generation portion 231 of the center heater 23$b$U in the longitudinal direction of the halogen heater 23U due to assembly error, variation in dimension of parts, and the like, the amount of heat generated by the halogen heater 23U may decrease substantially at the gap compared to other portions of the halogen heater 23U.

In order to address decrease in the amount of heat generated at the gap between the main heat generation portion 231 of the center heater 23$b$U and the main heat generation portion 231 of the lateral end heater 23$a$U in the longitudinal direction of the halogen heater 23U and temperature increase at each lateral end of the fixing belt 21 in the axial direction thereof where the sheet P is not conveyed over the fixing belt 21, according to this exemplary embodiment, the nip formation pad 24S depicted in FIG. 21 incorporates a thermal equalizer.

A description is provided of a construction of the nip formation pad 24S.

As illustrated in FIGS. 12 and 13, the nip formation pad 24S includes the thermal equalizer 41 serving as an increased thermal conductivity conductor, the thermal absorbers 42 and 43, the resin layer 44, and the base 51 serving as a decreased thermal conductivity conductor.

The thermal conductivity of the thermal equalizer 41 is greater than the thermal conductivity of the base 51. The thermal equalizer 41 is on the right of the base 51 and abuts the fixing belt 21 in FIG. 21. The thermal equalizer 41 contacts the fixing belt 21 throughout the entire width of the fixing belt 21 in the axial direction thereof to conduct heat on the surface of the fixing belt 21 in the axial direction thereof, evening the temperature of the outer circumferential surface of the fixing belt 21.

A thermal conductivity of each of the thermal absorbers 42 and 43 is greater than a thermal conductivity of the base 51. The thermal absorber 43 is disposed opposite the non-conveyance span of the fixing belt 21 where a small sheet P is not conveyed over the fixing belt 21. The non-conveyance span is disposed at each lateral end of the fixing belt 21 in the axial direction thereof and is susceptible to temperature increase described below. The thermal absorbers 42 and 43 facilitate conduction of heat vertically in FIG. 12 and horizontally in FIG. 21 in the thickness direction of the nip formation pad 24S. Accordingly, the absorption span of the nip formation pad 24S in the longitudinal direction thereof where the thermal absorber 43 is disposed facilitates conduction of heat in the thickness direction of the nip formation pad 24S compared to a span of the nip formation pad 24S in the longitudinal direction thereof where the base 51 is disposed, thus suppressing temperature increase or overheating of the fixing belt 21 in the absorption span. The thermal absorbers 42 and 43 compensate for shortage of the thermal capacity of the thermal equalizer 41. However, if each of the thermal absorbers 42 and 43 is thick excessively, the thermal absorbers 42 and 43 may facilitate conduction of heat excessively. To address this circumstance, the thermal absorbers 42 and 43 may be elongated in the longitudinal direction of the nip formation pad 24S compared to the thermal absorbers 42 and 43 illustrated in FIG. 12 or the thermal absorbers 42 and 43 may project from the base 51 in the circumferential direction of the fixing belt 21.

The resin layer 44 is sandwiched between the thermal equalizer 41 and the thermal absorber 43. The resin layer 44 is made of a material having a thermal conductivity smaller than that of the thermal equalizer 41 and the thermal absorbers 42 and 43. The thermal absorbers 42 and 43 conduct heat in the thickness direction of the nip formation pad 24S. However, the thermal absorbers 42 and 43 may conduct heat excessively. Accordingly, the fixing belt 21 may suffer from excessive temperature decrease in the axial span of the fixing belt 21 where the thermal absorber 43 is disposed. To address this circumstance, the resin layer 44 is sandwiched between the thermal equalizer 41 and the thermal absorber 43, suppressing excessive conduction of heat in the thickness direction of the nip formation pad 24S.

Thus, the nip formation pad 24S is constructed of the plurality of materials having different thermal conductivities, respectively, that is layered in the thickness direction of the nip formation pad 24S.

For example, each of the thermal equalizer 41 and the thermal absorbers 42 and 43 is made of carbon nanotube, graphite sheet, silver, copper, aluminum, SECC, or the like. For example, the base 51 is made of heat resistant resin such as PES, PPS, LCP, PEN, PAI, and PEEK.

As illustrated in FIG. 13, the width of the base 51 interposed between the two thermal absorbers 43 in the longitudinal direction of the nip formation pad 24S is substantially equal to the width of the minimum size sheet PA (e.g., the A6 size sheet) conveyed in the sheet conveyance direction DP.

A description is provided of a positional relation between the nip formation pad 24S and the halogen heater 23U.

Figure 26:
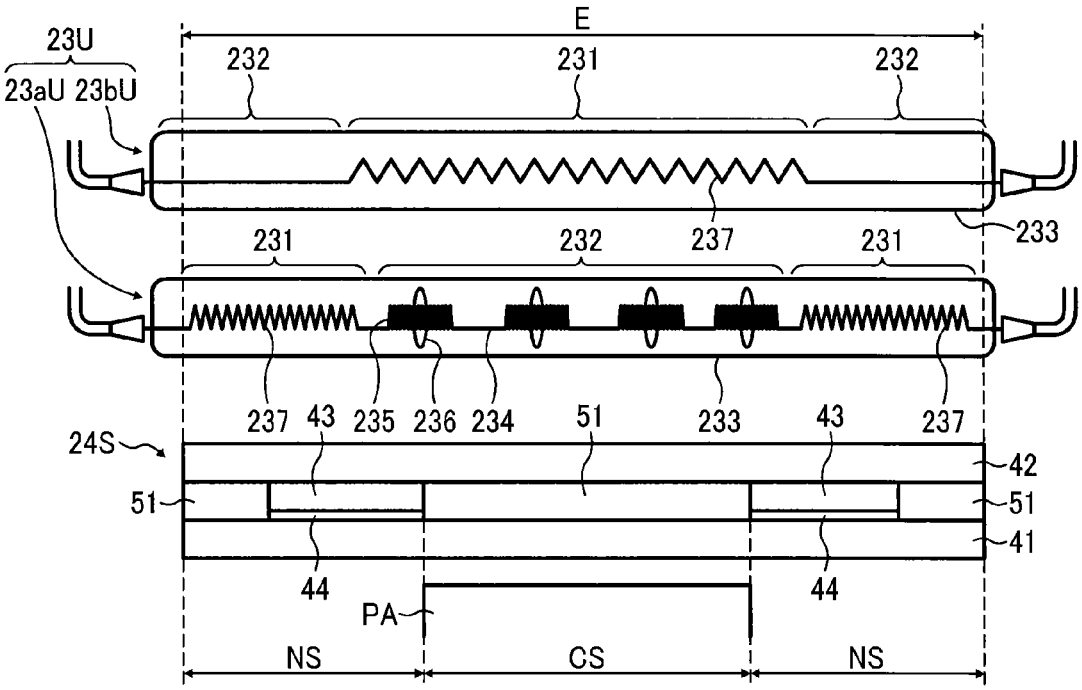
FIG. 26 is an exploded plan view of the halogen heater depicted in FIG. 22 and the nip formation pad depicted in FIG. 12.

FIG. 26 is an exploded plan view of the halogen heater 23U and the nip formation pad 24S. As illustrated in FIG. 26, the thermal equalizer 41 and the thermal absorber 42 span the entire heat generation span E in the longitudinal direction of the halogen heater 23U where the main heat generation portion 231 is disposed. The thermal absorber 43 is disposed opposite and spans from the gap between the main heat generation portion 231 of the lateral end heater 23$a$U and the main heat generation portion 231 of the center heater 23$b$U in the longitudinal direction of the halogen heater 23U. Accordingly, the halogen heater 23U suppresses sharp decrease in the amount of heat generated at the gap.

The sheet PA is not conveyed over a non-conveyance span NS of the fixing belt 21 that is disposed outboard in the axial direction of the fixing belt 21 from a conveyance span CS of the fixing belt 21 where the sheet PA is conveyed over the fixing belt 21. Accordingly, the sheet PA does not draw heat from the non-conveyance span NS of the fixing belt 21, causing temperature increase or overheating, that is, the lateral end temperature increase, of the non-conveyance span NS of the fixing belt 21 disposed at each lateral end of the fixing belt 21 in the axial direction thereof.

The non-conveyance span NS of the fixing belt 21 that suffers from the lateral end temperature increase is maximized when the minimum size sheet PA is conveyed over the fixing belt 21. The thermal equalizer 41 extends throughout the entire maximum non-conveyance span NS that is disposed outboard from the sheet PA and within the heat generation span E in the longitudinal direction of the halogen heater 23U. Accordingly, the thermal equalizer 41 conducts heat in the longitudinal direction and the thickness direction of the nip formation pad 24S in the non-conveyance span NS of the fixing belt 21, suppressing the lateral end temperature increase.

The rim projecting from each lateral end of the thermal equalizer 41 in the sheet conveyance direction DP toward the thermal absorber 42 may extend throughout the entire span of the thermal equalizer 41 in the longitudinal direction thereof. The thermal equalizer 41 and the rim mounted thereon produce a U-like shape in cross-section that accommodates the base 51, the resin layer 44, and the thermal absorbers 43 and 42 that are layered on the thermal equalizer 41 precisely. Alternatively, the projection may project from the inner face, that is, the upper face in FIG. 13, of the thermal equalizer 41 to engage the through-hole produced in each of the base 51, the resin layer 44, the thermal absorber 43, and the like.

The thermal absorbers 42 and 43 are manufactured as separate components, not as a single component, to reduce manufacturing costs. If the thermal absorbers 42 and 43 are manufactured as a single component, it is necessary to produce the recess that accommodates the base 51 by cutting, increasing manufacturing costs.

A detailed description is now given of the thickness of each of the components of the nip formation pad 24S when the nip length of the fixing nip N in the sheet conveyance direction DP is about 10 mm.

The thermal equalizer 41 has a thickness in a range of from 0.2 mm to 0.6 mm. The thermal absorber 42 has a thickness in a range of from 1.8 mm to 6.0 mm. The thermal absorber 43 has a thickness in a range of from 1.0 mm to 2.0 mm. The resin layer 44 has a thickness in a range of from 0.5 mm to 1.5 mm. The base 51 has a thickness in a range of from 1.5 mm to 3.5 mm. However, the thickness of the respective components is not limited to the above.

A description is provided of variations of the nip formation pad 24S.

FIGS. 15A and 15B illustrate the nip formation pads 24T and 24U, respectively, at the exit of the fixing nip N seen in the axial direction of the fixing belt 21. As illustrated in FIG. 15A, the bulge 45 projects from the thermal equalizer 41 sandwiched between the base 51 and the fixing belt 21 toward the pressure roller 22 depicted in FIG. 21 at the exit of the fixing nip N, that is, the downstream end of the fixing nip N in the sheet conveyance direction DP. The bulge 45 lifts the sheet P conveyed through the exit of the fixing nip N from the fixing belt 21, facilitating separation of the sheet P from the fixing belt 21. The low-friction sheet 59 is wound around the nip formation pad 24T to cover the thermal equalizer 41, the base 51, and the thermal absorber 42.

As illustrated in FIG. 15B, the bulge 45 projects from the thermal equalizer 41 toward the pressure roller 22 at the exit of the fixing nip N. The stopper 46 projects from the thermal equalizer 41 in the direction opposite the direction in which the bulge 45 projects from the thermal equalizer 41 along the downstream face of the base 51. The stopper 46 prevents the thermal equalizer 41 from moving in the circumferential direction of the fixing belt 21 even when the thermal equalizer 41 receives the predetermined force from the fixing belt 21 rotating in the rotation direction B1 and the sheet P conveyed in the sheet conveyance direction DP. The low-friction sheet 59 is wound around the nip formation pad 24U to cover the thermal equalizer 41. The end of the low-friction sheet 59 is nipped and secured between the base 51 and the stopper 46.

Figure 27:
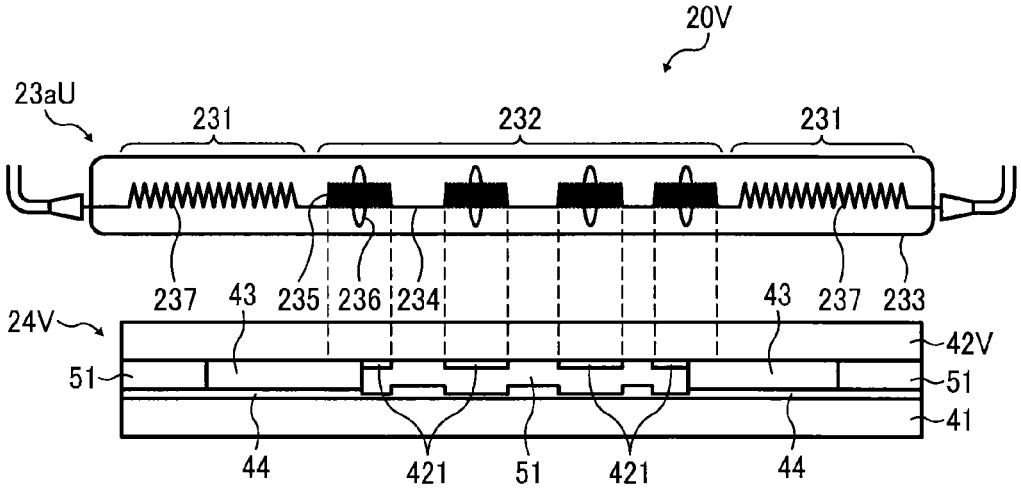
FIG. 27 is a partial exploded plan view of a fixing device according to a seventh exemplary embodiment of the present disclosure.

Referring to FIG. 27, a description is provided of a construction of a fixing device 20V according to a seventh exemplary embodiment that incorporates the nip formation pad 24V.

FIG. 27 is a partial exploded plan view of the fixing device 20V. As illustrated in FIG. 27, the nip formation pad 24V includes the thermal absorber 42V incorporating the plurality of projections 421 projecting toward the base 51. The projection 421 is disposed opposite the dense coil portion 235 and the supporter 236 in the sub heat generation portion 232 of the lateral end heater 23*a*U. The projection 421 increases the thickness of the thermal absorber 42V. The projection 421 that increases the thickness of the thermal absorber 42V is disposed opposite the dense coil portion 235 and the supporter 236 that constitute an increased heat generation portion of the lateral end heater 23*a*U in the sub heat generation portion 232 where the lateral end heater 23*a*U generates an increased amount of heat, thus evening the temperature of the fixing belt 21 in the axial direction thereof effectively.

According to this exemplary embodiment, the resin layer 44 spans throughout the entire width of the nip formation pad 24V in the longitudinal direction thereof. In order to offset the projection amount of the projection 421, the thickness of the resin layer 44 is decreased or the resin layer 44 is partially cut out to produce the recess that corresponds to the projection 421.

Instead of increasing the thickness of the thermal absorber 42V, the thickness of the thermal equalizer 41 may increase at a part of the thermal equalizer 41 that is disposed opposite the dense coil portion 235 and the supporter 236 so as to increase the thermal capacity of the thermal equalizer 41 at that part, thus evening the temperature of the fixing belt 21 in the axial direction thereof. For example, the thermal equalizer 41 may be straight at the entry to the fixing nip N and tilted toward the exit of the fixing nip N to enhance conveyance of the sheet P and prevent creasing of the sheet P effectively.

Figure 28:
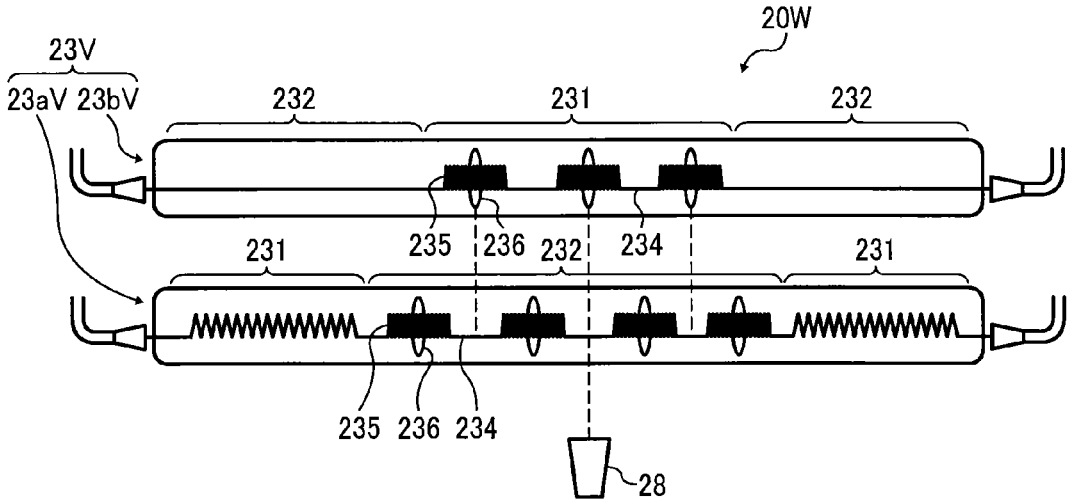
FIG. 28 is a partial plan view of a fixing device according to an eighth exemplary embodiment of the present disclosure.

Referring to FIG. 28, a description is provided of a construction of a fixing device 20W according to an eighth exemplary embodiment that incorporates a halogen heater 23V.

FIG. 28 is a plan view of the halogen heater 23V. As illustrated in FIG. 28, the halogen heater 23V includes a center heater 23*b*V and a lateral end heater 23*a*V. Each of the lateral end heater 23*a*V and the center heater 23*b*V is a non-partial heater. Each of the lateral end heater 23*a*V and the center heater 23*b*V includes a plurality of dense coil portions 235 and a plurality of supporters 236 aligned in a longitudinal direction of the halogen heater 23V with a predetermined interval between the adjacent dense coil portions 235 and the adjacent supporters 236.

The dense coil portion 235 and the supporter 236 of the center heater 23*b*V are disposed opposite the filament wire portion 234 of the lateral end heater 23*a*V. Conversely, the dense coil portion 235 and the supporter 236 of the lateral end heater 23*a*V are disposed opposite the filament wire portion 234 of the center heater 23*b*V. That is, the dense coil portion 235 and the supporter 236 of the center heater 23*b*V and the dense coil portion 235 and the supporter 236 of the lateral end heater 23*a*V are arranged alternately in the longitudinal direction of the halogen heater 23V. Accordingly, a wave crest of a temperature distribution of one of the center heater 23*b*V and the lateral end heater 23*a*V corresponds to a wave trough of the temperature distribution of another one of the center heater 23*b*V and the lateral end heater 23*a*V, thus evening the amount of heat conducted from the halogen heater 23V to the fixing belt 21 in the axial direction thereof or evening a temperature distribution of the fixing belt 21 in the axial direction thereof. For example, the number of the dense coil portions 235 and the supporters 236 of one of the center heater 23*b*V and the lateral end heater 23*a*V is an odd number. Conversely, the number of the dense coil portions 235 and the supporters 236 of another one of the center heater 23*b*V and the lateral end heater 23*a*V is an even number. Accordingly, the wave crest of the temperature distribution of one of the center heater 23*b*V and the lateral end heater 23$a$V corresponds to the wave trough of the temperature distribution of another one of the center heater 23$b$V and the lateral end heater 23$a$V, alternately.

The temperature sensor 28 is disposed opposite the intermediate position between the adjacent supporters 236, that is, the intermediate position between the adjacent dense coil portions 235, in the sub heat generation portion 232 of the lateral end heater 23$a$V in the longitudinal direction of the halogen heater 23V. That is, the temperature sensor 28 is disposed opposite a center or a vicinity of the center of the lateral end heater 23$a$V, that is, the center or the vicinity of the center of the fixing belt 21 in the axial direction thereof. In a center span of the halogen heater 23V in the longitudinal direction thereof, the temperature ripple T1 of the center heater 23$b$V is negligibly smaller than the temperature ripple T1 of the lateral end heater 23$a$V. Accordingly, the temperature sensor 28 is disposed opposite substantially the center of the fixing belt 21 in the axial direction thereof where the temperature of the outer circumferential surface of the fixing belt 21 is susceptible to temperature decrease most.

Since the temperature sensor 28 is disposed opposite the center or the vicinity of the center of the lateral end heater 23$a$V in the longitudinal direction of the halogen heater 23V, the number of the dense coil portions 235 and the supporters 236 in the sub heat generation portion 232 of the lateral end heater 23$a$V is the even number.

FIG. 28 illustrates the dense coil portions 235 and the supporters 236 disposed in a center span of the center heater 23$b$V and the lateral end heater 23$a$V in the longitudinal direction of the halogen heater 23V. That is, FIG. 28 omits the dense coil portions 235 and the supporters 236 disposed in each lateral end span of the lateral end heater 23$a$V in the longitudinal direction of the halogen heater 23V. Similarly, the dense coil portions 235 and the supporters 236 are alternately disposed in each lateral end span of the lateral end heater 23$a$V in the longitudinal direction of the halogen heater 23V.

Referring to FIG. 18, a description is provided of a construction of a fixing device according to a ninth exemplary embodiment.

FIG. 18 is a schematic exploded perspective view of the nip formation pad 24W incorporated in the fixing device according to the ninth exemplary embodiment. As illustrated in FIG. 18, the thermal absorber 43 is sandwiched between the thermal equalizer 41 and the thermal absorber 42 at two positions aligned in the longitudinal direction of the nip formation pad 24W like in the nip formation pad 24S depicted in FIG. 13. The thermal absorber 43 is embedded in the recess 52 provided in the base 51. Hence, the nip formation pad 24W includes the base 51, the thermal equalizer 41, and the thermal absorbers 42 and 43. The recess 52 does not penetrate through the base 51 so that the thickness of the recess 52 is smaller than the thickness of the portion of the base 51 that is not provided with the recess 52. In order to adjust an amount of heat conducted from the thermal equalizer 41 to the thermal absorber 42 through the thermal absorber 43, the thickness of the recess 52 is adjusted properly. The length of the recess 52 in the sheet conveyance direction DP is also adjusted properly based on the amount of heat to be absorbed by the thermal absorber 43. For example, the length of the recess 52 in the sheet conveyance direction DP is increased to allow the thermal absorber 43 to absorb an increased amount of heat. Conversely, the length of the recess 52 in the sheet conveyance direction DP is decreased to allow the thermal absorber 43 to absorb a decreased amount of heat. The thermal absorber 43 is leveled with the base 51 in the thickness direction of the nip formation pad 24W perpendicular to the longitudinal direction of the nip formation pad 24W so that the thermal absorber 43 and the base 51 share an identical plane. Alternatively, the recess 52 may penetrate through the base 51 so that the thickness of the recess 52 is equivalent to the thickness of the portion of the base 51 that is not provided with the recess 52.

Referring to FIGS. 19 and 20, a description is provided of a construction of a fixing device according to a tenth exemplary embodiment.

FIG. 19 is a schematic exploded perspective view of the nip formation pad 24X incorporated in the fixing device according to the tenth exemplary embodiment seen from the fixing nip N. FIG. 20 is a schematic exploded perspective view of the nip formation pad 24X seen from the stay 25 depicted in FIG. 21. The following describes a construction of the nip formation pad 24X that is different from the construction of the nip formation pads 24, 24S, 24T, 24U, 24V, and 24W described above.

The upstream end and the downstream end of the thermal equalizer 41 in the sheet conveyance direction DP are folded toward the stay 25 into the rims, respectively, to contour the thermal equalizer 41 into a U-shape in cross-section. Accordingly, the thermal equalizer 41 with the rims accommodates the base 51, the resin layer 44, and the thermal absorbers 43 and 42 that are layered on the thermal equalizer 41 precisely. The upstream end and the downstream end of the thermal equalizer 41 in the sheet conveyance direction DP mount the teeth 56. The teeth 56 are not contiguously produced throughout the entire span of the thermal equalizer 41 in the longitudinal direction thereof. For example, the planar portions are aligned in the longitudinal direction of the thermal equalizer 41 with the predetermined interval between the adjacent planar portions. The teeth 56 precisely catch or engage the low-friction sheet 59 depicted in FIGS. 15A and 15B that is wound around the outer circumferential surface of the nip formation pad 24X when the nip formation pad 24X is assembled, preventing the low-friction sheet 59 from being displaced in accordance with rotation of the fixing belt 21. The jig used to attach the low-friction sheet 59 to the nip formation pad 24X comes into contact with the planar portion of the thermal equalizer 41. As illustrated in FIG. 20, the teeth 56 are mounted on the rim of the thermal equalizer 41 at each lateral end thereof in the sheet conveyance direction DP. Alternatively, the teeth 56 may be mounted on one lateral end of the thermal equalizer 41 disposed opposite the entry to the fixing nip N in the sheet conveyance direction DP, that is, the lower end of the thermal equalizer 41 in FIG. 19. Since the fixing belt 21 moves from the entry to the exit of the fixing nip N, if the teeth 56 situated at the entry to the fixing nip N catch the low-friction sheet 59 precisely, it may not be necessary to produce the teeth 56 at the exit of the fixing nip N.

As illustrated in FIG. 20, the plurality of projections 58 projecting from the inner face of the base 51 toward the thermal absorber 42 is inserted into the plurality of through-holes 55, respectively. The plurality of projections 57 projecting from the inner face of the base 51 toward the thermal absorber 42 is inserted into the plurality of through-holes 54, respectively. The plurality of projections 57 projecting from the inner face of the resin layer 44 toward the thermal absorbers 43 and 42 is inserted into the plurality of through-holes 53, respectively. The projection 57 projecting from the resin layer 44 is inserted into the through-hole 53 penetrating through the thermal absorber 43 to hold the thermal absorber 43. The projection 57 projecting from the base 51 is inserted into the through-hole 54 penetrating through the thermal absorber 42 to hold the thermal absorber 42. The projection 58 projecting from the base 51 is inserted into the through-hole 55 penetrating through the thermal absorber 42 to hold the thermal absorber 42. The projection 58 is longer than the projection 57 in the projection direction perpendicular to the longitudinal direction of the nip formation pad 24X. Accordingly, the projection 58 penetrating through the through-hole 55 penetrating through the thermal absorber 42 engages the engagement hole of the stay 25, thus mounting or securing the entire nip formation pad 24X on the stay 25.

As illustrated in FIG. 19, the bulge 45 projects from the thermal equalizer 41 toward the pressure roller 22 at the downstream end of the thermal equalizer 41 disposed opposite the exit of the fixing nip N. For example, the thermal equalizer 41 is made of a single copper plate that is planar from the entry to the exit of the fixing nip N, that is, vertically upward in FIG. 19, and curved at the exit of the fixing nip N to project toward the pressure roller 22 depicted in FIG. 21, producing the bulge 45.

The present disclosure is not limited to the details of the exemplary embodiments described above and various modifications and improvements are possible.

According to the exemplary embodiments described above, the halogen heaters 23, 23S, 23T, 23U, and 23V heat the endless fixing belt 21 directly. Alternatively, each of the halogen heaters 23, 23S, 23T, 23U, and 23V may heat a fixing roller serving as a fixing rotator. Yet alternatively, the halogen heaters 23, 23S, 23T, 23U, and 23V may heat the fixing belt 21 indirectly through a metal pipe or a metal tube disposed opposite the inner circumferential surface of the fixing belt 21. However, the halogen heaters 23, 23S, 23T, 23U, and 23V heat the fixing belt 21 with the advantages described above because the fixing belt 21 has a decreased thermal capacity and is heated by the halogen heaters 23, 23S, 23T, 23U, and 23V directly, thereby being susceptible to increase in the temperature ripple T1 in the axial direction of the fixing belt 21.

A description is provided of advantages of the fixing devices 20, 20S, 20T, 20U, 20V, and 20W according to the first to tenth exemplary embodiments.

As illustrated in FIGS. 2 and 21, a fixing device (e.g., the fixing devices 20, 20S, 20T, 20U, 20V, and 20W) includes a fixing rotator (e.g., the fixing belt 21), an opposed rotator (e.g., the pressure roller 22), a nip formation pad (e.g., the nip formation pads 24, 24S, 24T, 24U, 24V, 24W, and 24X), a primary heater (e.g., the lateral end heaters 23*a*, 23*a*T, 23*a*U, and 23*a*V), a secondary heater (e.g., the center heaters 23*b*, 23*b*S, 23*b*T, 23*b*U, and 23*b*V), and a temperature sensor (e.g., the temperature sensor 28).

The fixing rotator is rotatable in a predetermined direction of rotation (e.g., the rotation direction B1). The opposed rotator contacts the fixing rotator to form the fixing nip N therebetween, through which a recording medium (e.g., a sheet P) bearing a toner image (e.g., a toner image TN) is conveyed. As the recording medium bearing the toner image is conveyed through the fixing nip N, the fixing rotator and the opposed rotator fix the toner image on the sheet. The nip formation pad is disposed opposite the opposed rotator via the fixing rotator to form the fixing nip N.

As illustrated in FIGS. 8 and 25, the primary heater includes a primary major heat generation portion (e.g., the primary major heat generation portion 231*a* and the main heat generation portion 231) disposed at a lateral end span of the primary heater in an axial direction of the fixing rotator and a primary minor heat generation portion (e.g., the primary minor heat generation portion 232*a* and the sub heat generation portion 232) disposed at a center span of the primary heater in the axial direction of the fixing rotator. In other words, the primary minor heat generation portion is disposed adjacent to the primary major heat generation portion in the axial direction of the fixing rotator.

The secondary heater includes a secondary major heat generation portion (e.g., the secondary major heat generation portion 231*b* and the main heat generation portion 231) disposed at a center span of the secondary heater in the axial direction of the fixing rotator and a secondary minor heat generation portion (e.g., the secondary minor heat generation portion 232*b* and the sub heat generation portion 232) disposed at a lateral end span of the secondary heater in the axial direction of the fixing rotator. The temperature sensor is disposed opposite the fixing rotator to detect the temperature of the fixing rotator. The primary minor heat generation portion includes a major heat generator (e.g., the dense coil portion 235) to generate an increased amount of heat and a minor heat generator (e.g., the filament wire portion 234) to generate a decreased amount of heat. The major heat generator and the minor heat generator span in the axial direction of the fixing rotator. In other words, the minor heat generator is disposed adjacent to the major heat generator in the axial direction of the fixing rotator. The temperature detector is disposed opposite the minor heat generator of the primary minor heat generation portion. A width of the major heat generator in the axial direction of the fixing rotator is not smaller than 30 percent and not greater than 35 percent with respect to a width of the primary minor heat generation portion in the axial direction of the fixing rotator.

The temperature detector detects the temperature of the fixing rotator at a position on the fixing rotator that is disposed opposite the minor heat generator or the non-heat generator interposed between the adjacent heat generators in the axial direction of the fixing rotator where the primary heater generates a decreased amount of heat. Since the temperature of the fixing rotator is adjusted based on the temperature of the fixing rotator detected at the position on the fixing rotator that suffers from temperature decrease, the primary heater and the secondary heater heat the fixing rotator readily to a desired fixing temperature such that the temperature of the fixing rotator does not decrease to a temperature lower than the desired fixing temperature. Accordingly, unlike a configuration in which the temperature of the fixing rotator is adjusted based on the temperature of the fixing rotator at a position thereon where the fixing rotator attains an increased temperature, a target temperature to which the primary heater and the secondary heater heat the fixing rotator is not excessively high, preventing redundant heating of the fixing rotator and therefore attaining energy saving of the fixing device.

According to the exemplary embodiments described above, the fixing belt 21 serves as a fixing rotator. Alternatively, a fixing roller, a fixing film, a fixing sleeve, or the like may be used as a fixing rotator. Further, the pressure roller 22 serves as an opposed rotator. Alternatively, a pressure belt or the like may be used as an opposed rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

an opposed rotator to press against the fixing rotator to form a fixing nip between the fixing rotator and the opposed rotator, the fixing nip through which a recording medium bearing a toner image is conveyed;

a primary heater, disposed opposite the fixing rotator, to heat the fixing rotator, the primary heater including:

a primary major heat generation portion; and a primary minor heat generation portion disposed adjacent to the primary major heat generation portion in an axial direction of the fixing rotator, the primary minor heat generation portion including:

at least one major heat generator to generate an increased amount of heat, the major heat generator having a width in the axial direction of the fixing rotator that is not smaller than 30 percent and not greater than 35 percent with respect to a width of the primary minor heat generation portion in the axial direction of the fixing rotator; and at least one minor heat generator, disposed adjacent to the at least one major heat generator in the axial direction of the fixing rotator, to generate a decreased amount of heat smaller than the increased amount of heat generated by the at least one major heat generator;

a secondary heater, disposed opposite the fixing rotator, to heat the fixing rotator, the secondary heater including:

a secondary major heat generation portion; and a secondary minor heat generation portion disposed adjacent to the secondary major heat generation portion in the axial direction of the fixing rotator; and a temperature detector, disposed opposite the at least one minor heat generator of the primary heater, to detect a temperature of the fixing rotator, wherein the primary heater and the secondary heater each include a respective filament lamp including a luminous tube and a filament wire disposed inside of the luminous tube, wherein the secondary major heat generation portion includes a dense coil portion where the filament wire is coiled densely, and one of a non-dense coil portion where the filament wire is coiled less densely than in the dense coil portion and a filament wire portion where the filament wire is substantially straight, and the at least one major heat generator is disposed opposite the one of the non-dense coil portion and the filament wire portion.

2. The fixing device according to claim 1, wherein the primary major heat generation portion is disposed at each lateral end span of the primary heater and the primary minor heat generation portion is disposed at a center span of the primary heater in the axial direction of the fixing rotator, and wherein the secondary major heat generation portion is disposed at a center span of the secondary heater and the secondary minor heat generation portion is disposed at each lateral end span of the secondary heater in the axial direction of the fixing rotator.

3. The fixing device according to claim 1, wherein a width rate of the at least one minor heat generator with respect to the width of the at least one major heat generator in the axial direction of the fixing rotator is not smaller than 1.50 and not greater than 1.90.

4. The fixing device according to claim 1, wherein the at least one major heat generator includes a dense coil portion where the filament wire is coiled densely, and wherein the at least one minor heat generator includes one of a non-dense coil portion where the filament wire is coiled less densely than in the dense coil portion and a filament wire portion where the filament wire is substantially straight.

5. The fixing device according to claim 1, wherein the secondary major heat generation portion corresponds to a width of an A4 size sheet in portrait orientation in the axial direction of the fixing rotator, and wherein the primary minor heat generation portion includes twelve major heat generators.

6. The fixing device according to claim 1, further comprising a nip formation pad disposed opposite the opposed rotator via the fixing rotator to form the fixing nip.

7. The fixing device according to claim 1, wherein the fixing rotator includes an endless belt, wherein the opposed rotator includes a pressure roller, and wherein each of the primary heater and the secondary heater further includes a halogen heater.

8. An image forming apparatus comprising the fixing device according to claim 1.

9. The fixing device according to claim 1, further comprising:

a nip formation pad including:

a base serving as a decreased thermal conductivity conductor; and a thermal equalizer serving as an increased thermal conductivity conductor sandwiched between the base and the fixing rotator.

10. A fixing device comprising:

a fixing rotator rotatable in a predetermined direction of rotation;

an opposed rotator to press against the fixing rotator to form a fixing nip between the fixing rotator and the opposed rotator, the fixing nip through which a recording medium bearing a toner image is conveyed;

a primary heater, disposed opposite the fixing rotator, to heat the fixing rotator, the primary heater including:

a primary major heat generation portion; and a primary minor heat generation portion disposed adjacent to the primary major heat generation portion in an axial direction of the fixing rotator, the primary minor heat generation portion including:

a major heat generator to generate an increased amount of heat; and a minor heat generator, disposed adjacent to the major heat generator in the axial direction of the fixing rotator, to generate a decreased amount of heat smaller than the increased amount of heat of the major heat generator, the minor heat generator having a width rate with respect to a width of the major heat generator in the axial direction of the fixing rotator that is not smaller than 1.50 and not greater than 1.90;

a secondary heater, disposed opposite the fixing rotator, to heat the fixing rotator, the secondary heater including:

a secondary major heat generation portion; and a secondary minor heat generation portion disposed adjacent to the secondary major heat generation portion in the axial direction of the fixing rotator; and a temperature detector, disposed opposite the fixing rotator, to detect a temperature of the fixing rotator, wherein the primary heater and the secondary heater each include a respective filament lamp including a luminous tube and a filament wire disposed inside of the luminous tube, wherein the secondary major heat generation portion includes a dense coil portion where the filament wire is coiled densely, and one of a non-dense coil portion where the filament wire is coiled less densely than in the dense coil portion and a filament wire portion where the filament wire is substantially straight, and the major heat generator is disposed opposite the one of the non-dense coil portion and the filament wire portion.

11. The fixing device according to claim 10, further comprising a nip formation pad disposed opposite the opposed rotator via the fixing rotator to form the fixing nip, wherein the primary major heat generation portion is disposed at each lateral end span of the primary heater and the primary minor heat generation portion is disposed at a center span of the primary heater in the axial direction of the fixing rotator, and wherein the secondary major heat generation portion is disposed at a center span of the secondary heater and the secondary minor heat generation portion is disposed at each lateral end span of the secondary heater in the axial direction of the fixing rotator.

12. The fixing device according to claim 10, further comprising: a nip formation pad including:

a base serving as a decreased the conductivity conductor; and a thermal equalizer serving as an increased thermal conductivity conductor sandwiched between the base and the fixing rotator.

13. An image forming apparatus comprising the fixing device according to claim 10.

14. A fixing device comprising:

a fixing rotator rotatable in a predetermined direction of rotation;

an opposed rotator to press against the fixing rotator to form a fixing nip between the fixing rotator and the opposed rotator, the fixing nip through which a recording medium bearing a toner image is conveyed;

a plurality of heaters, disposed in the direction of rotation of the fixing rotator, to heat the fixing rotator, each of the plurality of heaters including:

a primary heater, disposed opposite the fixing rotator, to heat the fixing rotator, the primary heater including:

a primary major heat generation portion; and a primary minor heat generation portion disposed adjacent to the primary major heat generation portion in an axial direction of the fixing rotator, the primary minor heat generation portion including:

at least one major heat generator to generate an increased amount of heat, the major heat generator having a width in the axial direction of the fixing rotator that is not smaller than 30 percent and not greater than 35 percent with respect to a width of the primary minor heat generation portion in the axial direction of the fixing rotator; and at least one minor heat generator, disposed adjacent to the at least one major heat generator in the axial direction of the fixing rotator, to generate a decreased amount of heat smaller than the increased amount of heat generated by the at least one major heat generator;

a secondary heater, disposed opposite the fixing rotator, to heat the fixing rotator, the secondary heater including:

a secondary major heat generation portion; and a secondary minor heat generation portion disposed adjacent to the secondary major heat generation portion in the axial direction of the fixing rotator; and a temperature detector, disposed opposite the at least one minor heat generator of the primary heater, to detect a temperature of the fixing rotator, the temperature detector disposed upstream from the primary heater and the secondary heater in the direction of rotation of the fixing rotator, wherein the primary heater and the secondary heater each include a respective filament lamp including a luminous tube and a filament wire disposed inside of the luminous tube, wherein the secondary major heat generation portion includes a dense coil portion where the filament wire is coiled densely, and one of a non-dense coil portion where the filament wire is coiled less densely than in the dense coil portion and a filament wire portion where the filament wire is substantially straight, and wherein the at least one major heat generator is disposed opposite the one of the non- dense coil portion and the filament wire portion.

15. The fixing device according to claim 14, wherein the temperature detector is disposed between the primary heater and the secondary heater in the axial direction of the fixing rotator.

16. The fixing device according to claim 14, wherein the temperature detector is disposed opposite substantially a center of the recording medium in the axial direction of the fixing rotator.

17. The fixing device according to claim 14, further comprising a nip formation pad disposed opposite the opposed rotator via the fixing rotator to form the fixing nip.

18. The fixing device according to claim 17, wherein the nip formation pad includes:

a decreased thermal conductivity conductor having a decreased thermal conductivity; and an increased thermal conductivity conductor having an increased thermal conductivity greater than the decreased thermal conductivity of the decreased then mal conductivity conductor, and wherein the increased thermal conductivity conductor spans an entire width of the fixing rotator in the axial direction of the fixing rotator.

19. The fixing device according to claim 18, wherein a non-conveyance span where the recording medium having a decreased width is not conveyed over the fixing rotator is disposed outboard from the primary major heat generation portion in the axial direction of the fixing rotator, and wherein the increased thermal conductivity conductor spans an entire non-conveyance span in the axial direction of the fixing rotator.

20. The fixing device according to claim 18, wherein the primary heater further includes:

a luminous tube;

a filament wire disposed inside the luminous tube; and a supporter contacting the luminous tube and supporting the filament wire.

21. The fixing device according to claim 20, wherein the nip formation pad further includes:

a thermal absorber to absorb heat, the thermal absorber including a projection being disposed opposite the supporter and projecting toward the decreased thermal conductivity conductor to increase a thickness of the thermal absorber.

22. The fixing device according to claim 14, wherein the primary heater further includes:

a lateral end heater as the primary major heat portion disposed opposite each lateral end span of the fixing rotator in the axial direction of the fixing rotator; and a center heater as the primary minor heat generation portion disposed opposite a center span of the fixing rotator in the axial direction of the fixing rotator.

23. The fixing device according to claim 22, wherein each of the lateral end heater and the center heater includes:

a luminous tube;

a filament wire disposed inside the luminous tube; and a supporter contacting the luminous tube and supporting the filament wire, and wherein the supporter of the lateral end heater and the supporter of the center heater are arranged alternately in the axial direction of the fixing rotator.

24. An image forming apparatus comprising the fixing device according to claim 14.

* * * * *